US007337768B2

(12) United States Patent
Elia et al.

(10) Patent No.: US 7,337,768 B2
(45) Date of Patent: Mar. 4, 2008

(54) MULTIPLE CAPILLARY FUEL INJECTOR FOR AN INTERNAL COMBUSTION ENGINE

(75) Inventors: Mimmo Elia, Watertown, MA (US); Jan-Roger Linna, Boston, MA (US); John Paul Mello, Belmont, MA (US)

(73) Assignee: Philip Morris USA Inc., Richmond, VA (US)

( * ) Notice: Subject to any disclaimer, the term of this patent is extended or adjusted under 35 U.S.C. 154(b) by 662 days.

(21) Appl. No.: 10/841,718

(22) Filed: May 7, 2004

(65) Prior Publication Data

US 2005/0258266 A1 Nov. 24, 2005

(51) Int. Cl.
*F02M 51/00* (2006.01)

(52) U.S. Cl. ..... 123/549; 123/557

(58) Field of Classification Search ..... 123/549, 123/557, 304, 179.21; 239/131–133
See application file for complete search history.

(56) References Cited

U.S. PATENT DOCUMENTS

| | | | | |
|---|---|---|---|---|
| 3,716,416 A | | 2/1973 | Adlhart et al. | 429/23 |
| 3,731,880 A | * | 5/1973 | Williams | 239/585.1 |
| 3,868,939 A | | 3/1975 | Friese et al. | 123/179 L |
| 3,999,525 A | | 12/1976 | Stumpp et al. | 123/122 E |
| 4,034,729 A | | 7/1977 | Omachi et al. | 123/122 G |
| 4,210,103 A | | 7/1980 | Dimitroff et al. | 123/1 A |

(Continued)

FOREIGN PATENT DOCUMENTS

DE 482 591 C 2/1930

(Continued)

OTHER PUBLICATIONS

Boyle R J et al: "Cold Start Performance Of An Automobile Engine Using Prevaporized Gasoline" SAE Technical Paper Series, Society of Automotive Engineers, Warrendale, PA. US. vol. 102, No. 3, 1993, pp. 949-957. XP000564352; ISSN: 0148-7191, p. 950-p. 951.

*Primary Examiner*—Marguerite McMahon
(74) *Attorney, Agent, or Firm*—Roberts, Mlotkowski & Hobbes

(57) ABSTRACT

A fuel injector for delivering fuel to an internal combustion engine. The fuel injector includes a fuel injector housing, a system for metering vaporized fuel to the internal combustion engine, the system positioned within the fuel injector housing, and a system for delivering an atomized stream of liquid fuel to an internal combustion engine, the system positioned within the fuel injector housing, wherein the fuel injector is operable to transition from metering vaporized fuel to delivering an atomized stream of liquid fuel to an internal combustion engine. The system for metering vaporized fuel includes at least one capillary flow passage, the at least one capillary flow passage having an inlet end and an outlet end; a heat source arranged along the at least one capillary flow passage, the heat source operable to heat the liquid fuel in the at least one capillary flow passage to a level sufficient to change from the liquid state to a vapor state and deliver a stream of vaporized fuel from the outlet end of the at least one capillary flow passage. The system for metering vaporized fuel further includes a valve for metering vaporized fuel located downstream to the outlet end of the at least one capillary flow passage. The fuel injector is effective in reducing cold-start and warm-up emissions of an internal combustion engine.

(Continued)

75 Claims, 11 Drawing Sheets

U.S. PATENT DOCUMENTS

| | | | | |
|---|---|---|---|---|
| 4,218,021 | A | 8/1980 | Palma | 239/585 |
| 4,223,652 | A | 9/1980 | Budnicki | 123/440 |
| 4,344,402 | A | 8/1982 | Child et al. | 123/538 |
| 4,345,569 | A | 8/1982 | Hattori et al. | 123/549 |
| 4,356,980 | A | 11/1982 | Krauss | 239/585 |
| 4,395,989 | A | 8/1983 | Eshelman et al. | 123/478 |
| 4,403,576 | A | 9/1983 | Dimitroff et al. | 123/3 |
| 4,458,655 | A | 7/1984 | Oza | 123/558 |
| 4,477,027 | A | 10/1984 | Knapp et al. | 239/585 |
| 4,483,307 | A | 11/1984 | Gilmor | 123/558 |
| 4,784,213 | A | 11/1988 | Eager et al. | 165/2 |
| 4,870,932 | A | 10/1989 | Asmus | 123/179 |
| 4,886,032 | A | 12/1989 | Asmus | 123/559 |
| 4,955,351 | A | 9/1990 | Lewis et al. | 123/557 |
| 4,958,773 | A | 9/1990 | Stettner et al. | 239/584 |
| 4,958,774 | A | 9/1990 | Taylor | 239/584 |
| 5,040,497 | A | 8/1991 | Dingle | 123/179 H |
| 5,054,454 | A | 10/1991 | Hamburg | 123/520 |
| 5,121,730 | A | 6/1992 | Ausman et al. | 123/467 |
| 5,195,477 | A | 3/1993 | Hudson, Jr. et al. | 123/179.7 |
| 5,226,400 | A | 7/1993 | Birch | 123/543 |
| 5,273,215 | A | 12/1993 | Hans et al. | 239/288.5 |
| 5,331,937 | A | 7/1994 | Clarke | 123/491 |
| 5,332,046 | A | 7/1994 | Tanimizu et al. | 172/739 |
| 5,343,848 | A | 9/1994 | Birch et al. | 123/557 |
| 5,408,967 | A | 4/1995 | Foster | 123/294 |
| 5,449,114 | A * | 9/1995 | Wells et al. | 239/5 |
| 5,479,906 | A * | 1/1996 | Collie | 123/525 |
| 5,482,023 | A | 1/1996 | Hunt et al. | 123/491 |
| 5,524,582 | A | 6/1996 | Suh et al. | 123/179.8 |
| 5,529,035 | A | 6/1996 | Hunt et al. | 123/179.15 |
| 5,685,494 | A | 11/1997 | Kubach et al. | 239/585.5 |
| 5,743,251 | A | 4/1998 | Howell et al. | 128/200.14 |
| 5,758,826 | A | 6/1998 | Nines | 239/136 |
| 5,813,388 | A | 9/1998 | Cikanek, Jr. et al. | 123/549 |
| 5,823,444 | A | 10/1998 | Reiter et al. | 239/533.12 |
| 5,836,289 | A | 11/1998 | Thring | 123/549 |
| 5,894,832 | A | 4/1999 | Nogi et al. | 123/491 |
| 5,947,091 | A | 9/1999 | Krohn et al. | 123/549 |
| 6,026,787 | A | 2/2000 | Sun et al. | 123/525 |
| 6,067,970 | A | 5/2000 | Awarzamani et al. | 123/549 |
| 6,067,971 | A | 5/2000 | Cikanek, Jr. et al. | 123/549 |
| 6,079,636 | A | 6/2000 | Rembold et al. | 239/88 |
| 6,102,303 | A | 8/2000 | Bright et al. | 239/135 |
| 6,109,247 | A | 8/2000 | Hunt | 123/549 |
| 6,119,670 | A | 9/2000 | Lavi | 123/674 |
| 6,145,494 | A | 11/2000 | Klopp | 123/525 |
| 6,189,516 | B1 | 2/2001 | Hei Ma | 123/524 |
| 6,189,518 | B1 | 2/2001 | Cooke | 123/549 |
| 6,189,803 | B1 | 2/2001 | Ganan-Calvo | 239/5 |
| 6,209,309 | B1 | 4/2001 | McArthur | 60/39.03 |
| 6,234,153 | B1 | 5/2001 | DeGroot et al. | 123/525 |
| 6,237,576 | B1 | 5/2001 | Buccino et al. | 123/549 |
| 6,267,307 | B1 | 7/2001 | Pontoppidan | 239/585.4 |
| 6,276,347 | B1 | 8/2001 | Hunt | 123/549 |
| 6,289,881 | B1 | 9/2001 | Klopp | 123/525 |
| 6,332,457 | B1 | 12/2001 | Imoehl | 123/549 |
| 6,354,256 | B1 | 3/2002 | Ohanian et al. | 123/179.21 |
| 6,357,677 | B1 | 3/2002 | Ren et al. | 239/585.4 |
| 6,360,960 | B1 | 3/2002 | Nally, Jr. et al. | 239/5 |
| 6,390,076 | B2 | 5/2002 | Hunt | 123/549 |
| 6,499,674 | B2 | 12/2002 | Ren et al. | 239/407 |
| 6,502,761 | B1 | 1/2003 | Pace et al. | 239/5 |
| 6,550,696 | B2 | 4/2003 | Mansour et al. | 239/399 |
| 6,568,390 | B2 | 5/2003 | Nichols et al. | 128/203.16 |
| 6,575,382 | B1 * | 6/2003 | Fischer et al. | 239/5 |
| 6,779,513 | B2 * | 8/2004 | Pellizzari et al. | 123/549 |
| 6,820,598 | B2 * | 11/2004 | Pellizzari et al. | 123/549 |
| 6,845,760 | B2 * | 1/2005 | Linna et al. | 123/480 |
| 6,913,004 | B2 * | 7/2005 | Pellizzari et al. | 123/549 |
| 2001/0020469 | A1 | 9/2001 | Hunt | 123/549 |
| 2001/0030249 | A1 * | 10/2001 | Nagasaka et al. | 239/585.1 |
| 2001/0054608 | A1 | 12/2001 | Ohkuma et al. | 219/205 |
| 2002/0053610 | A1 * | 5/2002 | Takagi et al. | 239/533.2 |
| 2002/0130193 | A1 | 9/2002 | Peterson, Jr. | 239/5 |
| 2002/0130284 | A1 | 9/2002 | Knebel et al. | 251/11 |
| 2003/0056790 | A1 | 3/2003 | Nichols et al. | 128/203.16 |
| 2003/0057300 | A1 | 3/2003 | Peterson, Jr. | 239/533.12 |
| 2003/0127614 | A1 * | 7/2003 | Haeberer et al. | 251/50 |
| 2003/0170810 | A1 | 9/2003 | Pellizzari et al. | 123/549 |
| 2003/0170811 | A1 | 9/2003 | Pellizzari et al. | 123/549 |
| 2006/0094566 | A1 * | 5/2006 | Keeler et al. | 477/111 |

FOREIGN PATENT DOCUMENTS

| | | |
|---|---|---|
| DE | 40 22 335 | 1/1992 |
| DE | 195 46 851 | 6/1997 |
| DE | 37 19 234 | 12/1998 |
| EP | 0 849 375 | 6/1998 |
| EP | 0 915 248 | 5/1999 |
| FR | 2 742 811 | 6/1997 |
| GB | 2 147 949 | 5/1985 |
| JP | 58-110854 | 7/1983 |
| JP | 5-141329 | 6/1993 |
| JP | 411-062773 | 3/1999 |
| WO | WO 87/00887 | 2/1987 |
| WO | WO 03/083281 | 10/2003 |

* cited by examiner

FIG. 5
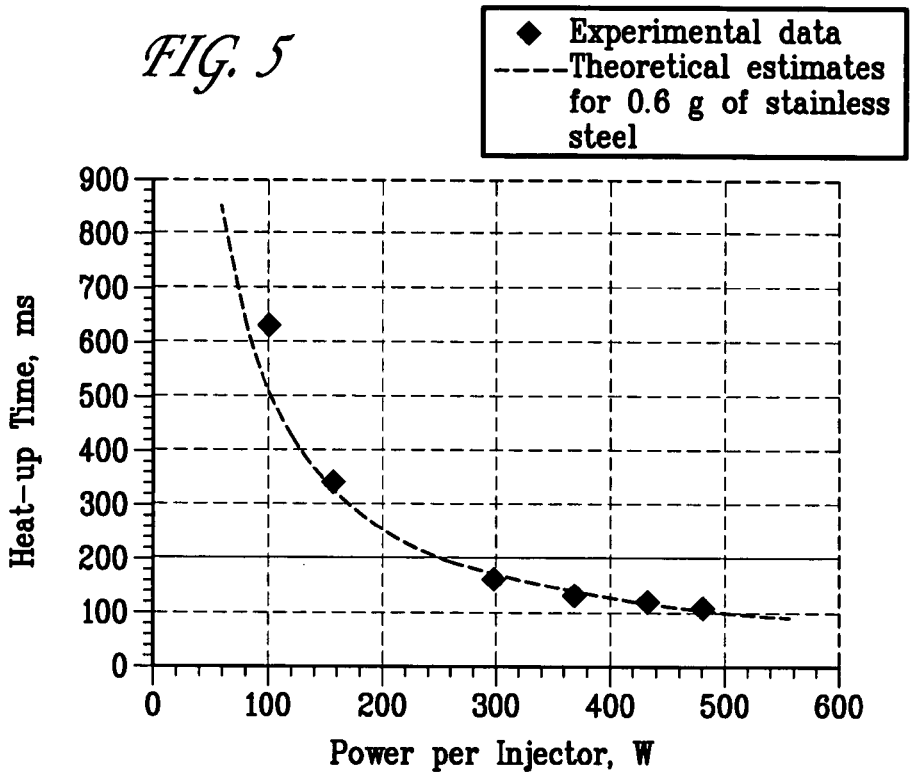
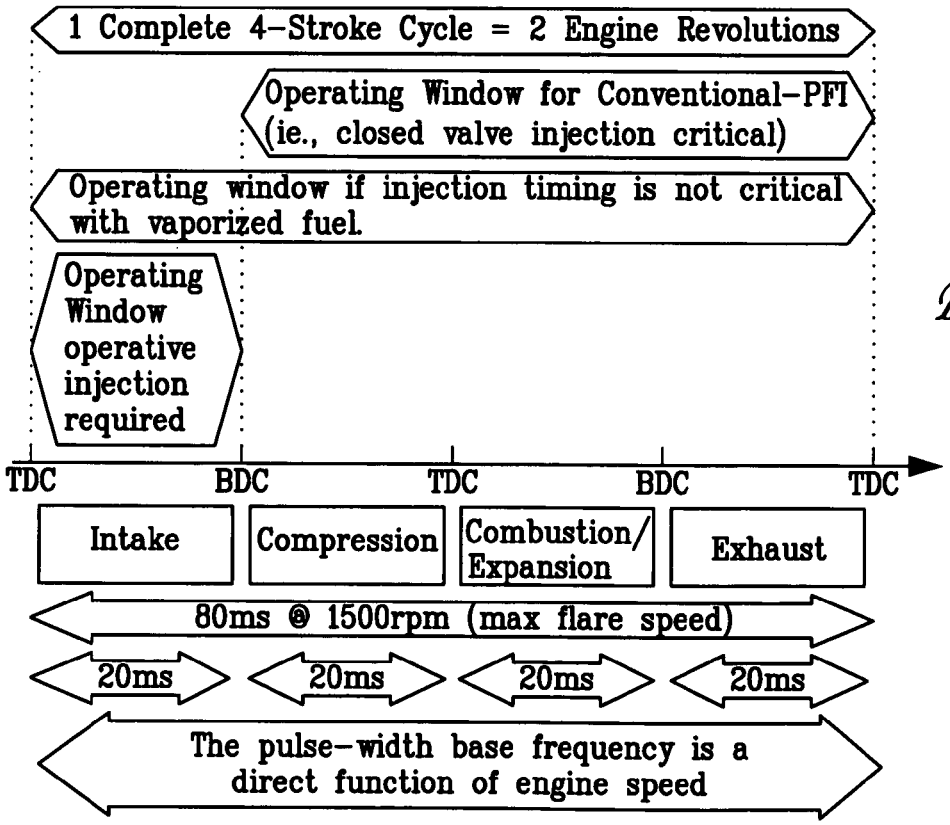
FIG. 6

MULTIPLE CAPILLARY FUEL INJECTOR FOR AN INTERNAL COMBUSTION ENGINE

FIELD

The present invention relates to fuel delivery in an internal combustion engine.

BACKGROUND

Since the 1970's, port-fuel injected engines have utilized three-way catalysts and closed-loop engine controls in order to seek to minimize $NO_x$, CO, and unburned hydrocarbon emissions. This strategy has proven to be particularly effective during normal operation in which the engine and exhaust components have reached sufficient temperatures. However, in order to achieve desirable conversion efficiencies of $NO_x$, CO, and unburned hydrocarbons, the three-way catalyst must be above its inherent catalyst light-off temperature.

In addition, the engine must be at sufficient temperature to allow for vaporization of liquid fuel as it impinges upon intake components, such as port walls and/or the back of valves. The effectiveness of this process is important in that it provides a proper degree of control over the stoichiometry of the fuel/air mixture and, thus, is coupled to idle quality and the performance of the three-way catalyst, and it ensures that the fuel supplied to the engine is burned during combustion and, thus, eliminates the need for over-fueling to compensate for liquid fuel that does not vaporize sufficiently and/or collects on intake components.

In order for combustion to be chemically complete, the fuel-air mixture must be vaporized to a stoichiometric gas-phase mixture. A stoichiometric combustible mixture contains the exact quantities of air (oxygen) and fuel required for complete combustion. For gasoline, this air-to-fuel ratio is about 14.7:1 by weight. A fuel-air mixture that is not completely vaporized, and/or contains more than a stoichiometric amount of fuel, results in incomplete combustion and reduced thermal efficiency. The products of an ideal combustion process are water ($H_2O$) and carbon dioxide ($CO_2$). If combustion is incomplete, some carbon is not fully oxidized, yielding carbon monoxide (CO) and unburned hydrocarbons (HC).

Under cold-start and warm-up conditions, the processes used to reduce exhaust emissions and deliver high quality fuel vapor break down due to relatively cool temperatures. In particular, the effectiveness of three-way catalysts is not significant below approximately 250° C. and, consequently, a large fraction of unburned hydrocarbons pass unconverted to the environment. Under these conditions, the increase in hydrocarbon emissions is exacerbated by over-fueling required during cold-start and warm-up. That is, since fuel is not readily vaporized through impingement on cold intake manifold components, over-fueling is necessary to create combustible mixtures for engine starting and acceptable idle quality.

The mandates to reduce air pollution worldwide have resulted in attempts to compensate for combustion inefficiencies with a multiplicity of fuel system and engine modifications. As evidenced by the prior art relating to fuel preparation and delivery systems, much effort has been directed to reducing liquid fuel droplet size, increasing system turbulence and providing sufficient heat to vaporize fuels to permit more complete combustion.

However, inefficient fuel preparation at lower engine temperatures remains a problem which results in higher emissions, requiring after-treatment and complex control strategies. Such control strategies can include exhaust gas recirculation, variable valve timing, retarded ignition timing, reduced compression ratios, the use of catalytic converters and air injection to oxidize unburned hydrocarbons and produce an exothermic reaction benefiting catalytic converter light-off.

As indicated, over-fueling the engine during cold-start and warm-up is a significant source of unburned hydrocarbon emissions in conventional engines. It has been estimated that as much as 80 percent of the total hydrocarbon emissions produced by a typical, modern port fuel injected (PFI) gasoline engine passenger car occurs during the cold-start and warm-up period, in which the engine is over-fueled and the catalytic converter is essentially inactive.

Given the relatively large proportion of unburned hydrocarbons emitted during startup, this aspect of passenger car engine operation has been the focus of significant technology development efforts. Furthermore, as increasingly stringent emissions standards are enacted into legislation and consumers remain sensitive to pricing and performance, these development efforts will continue to be paramount. Such efforts to reduce start-up emissions from conventional engines generally fall into two categories: 1) reducing the warm-up time for three-way catalyst systems and 2) improving techniques for fuel vaporization. Efforts to reduce the warm-up time for three-way catalysts to date have included: retarding the ignition timing to elevate the exhaust temperature; opening the exhaust valves prematurely; electrically heating the catalyst; burner or flame heating the catalyst; and catalytically heating the catalyst. As a whole, these efforts are costly and do not address HC emissions during and immediately after cold start.

A variety of techniques have been proposed to address the issue of fuel vaporization. U.S. Patents proposing fuel vaporization techniques include U.S. Pat. No. 5,195,477 issued to Hudson, Jr. et al, U.S. Pat. No. 5,331,937 issued to Clarke, U.S. Pat. No. 4,886,032 issued to Asmus, U.S. Pat. No. 4,955,351 issued to Lewis et al., U.S. Pat. No. 4,458,655 issued to Oza, U.S. Pat. No. 6,189,518 issued to Cooke, U.S. Pat. No. 5,482,023 issued to Hunt, U.S. Pat. No. 6,109,247 issued to Hunt, U.S. Pat. No. 6,067,970 issued to Awarzamani et al., U.S. Pat. No. 5,947,091 issued to Krohn et al., U.S. Pat. No. 5,758,826 issued to Nines, U.S. Pat. No. 5,836,289 issued to Thring, and U.S. Pat. No. 5,813,388 issued to Cikanek, Jr. et al.

Other fuel delivery devices proposed include U.S. Pat. No. 3,716,416, which discloses a fuel-metering device for use in a fuel cell system. The fuel cell system is intended to be self-regulating, producing power at a predetermined level. The proposed fuel metering system includes a capillary flow control device for throttling the fuel flow in response to the power output of the fuel cell, rather than to provide improved fuel preparation for subsequent combustion. Instead, the fuel is intended to be fed to a fuel reformer for conversion to $H_2$ and then fed to a fuel cell. In a preferred embodiment, the capillary tubes are made of metal and the capillary itself is used as a resistor, which is in electrical contact with the power output of the fuel cell. Because the flow resistance of a vapor is greater than that of a liquid, the flow is throttled as the power output increases. The fuels suggested for use include any fluid that is easily transformed from a liquid to a vapor phase by applying heat and flows freely through a capillary. Vaporization appears to be achieved in the manner that vapor lock occurs in automotive engines.

U.S. Pat. No. 6,276,347 proposes a supercritical or near-supercritical atomizer and method for achieving atomization or vaporization of a liquid. The supercritical atomizer of U.S. Pat. No. 6,276,347 is said to enable the use of heavy fuels to fire small, light weight, low compression ratio, spark-ignition piston engines that typically burn gasoline. The atomizer is intended to create a spray of fine droplets from liquid, or liquid-like fuels, by moving the fuels toward their supercritical temperature and releasing the fuels into a region of lower pressure on the gas stability field in the phase diagram associated with the fuels, causing a fine atomization or vaporization of the fuel. Utility is disclosed for applications such as combustion engines, scientific equipment, chemical processing, waste disposal control, cleaning, etching, insect control, surface modification, humidification and vaporization.

To minimize decomposition of the fuel, U.S. Pat. No. 6,276,347 proposes keeping the fuel below the supercritical temperature until passing the distal end of a restrictor for atomization. For certain applications, heating just the tip of the restrictor is desired to minimize the potential for chemical reactions or precipitations. This is said to reduce problems associated with impurities, reactants or materials in the fuel stream which otherwise tend to be driven out of solution, clogging lines and filters. Working at or near supercritical pressure suggests that the fuel supply system operate in the range of 300 to 800 psig. While the use of supercritical pressures and temperatures might reduce clogging of the atomizer, it appears to require the use of a relatively more expensive fuel pump, as well as fuel lines, fittings and the like that are capable of operating at these elevated pressures.

Despite these and other advances in the art, there exists a need for injector designs capable of delivering improved vaporization while still meeting critical design requirements such as acceptable pressure drop across the injector, acceptable vaporized fuel flow rate at 100% duty cycle, acceptable liquid fuel flow rate at 100% duty cycle, exhibit minimal heat-up time, possess minimal power requirement, exhibit a linear relationship between duty cycle and vaporized fuel flow and exhibit a linear relationship between duty cycle and liquid fuel flow.

SUMMARY

In one aspect, a fuel injector for delivering fuel to an internal combustion engine is provided. The fuel injector includes a fuel injector housing, a system for metering vaporized fuel to the internal combustion engine, the system positioned within the fuel injector housing, and a system for delivering an atomized stream of liquid fuel to an internal combustion engine, the system positioned within the fuel injector housing, wherein the fuel injector is operable to transition from metering vaporized fuel to delivering an atomized stream of liquid fuel to an internal combustion engine. In one form, the system for metering vaporized fuel may include at least one capillary flow passage mounted within the fuel injector housing, the at least one capillary flow passage having an inlet end and an outlet end, and a heat source arranged along the at least one capillary flow passage, the heat source operable to heat the fuel within each of the at least one capillary flow passage to a level sufficient to change the fuel from a liquid state to a vapor state and deliver vaporized fuel from the outlet end of the at least one capillary flow passage.

In another aspect, a fuel injector for vaporizing a liquid fuel for use in an internal combustion engine is provided. The fuel injector includes at least one a capillary flow passages, the at least one capillary flow passage having an inlet end and an outlet end; a heat source arranged along the at least one capillary flow passage, the heat source operable to heat the liquid fuel in each of the at least one capillary flow passage to a level sufficient to change from the liquid state to a vapor state and deliver a stream of vaporized fuel from the outlet end of the at least one capillary flow passage; and a valve for metering vaporized fuel to the internal combustion engine, the valve located proximate to the outlet end of the at least one capillary flow passage.

In yet another aspect, a fuel system for use in an internal combustion engine is provided. The fuel system provides a plurality of fuel injectors, each of the plurality of fuel injectors having an inlet and an outlet and including: a fuel injector housing, a system for metering vaporized fuel to the internal combustion engine, the system positioned within the fuel injector housing, and a system for delivering an atomized stream of liquid fuel to an internal combustion engine, the system positioned within the fuel injector housing, a liquid fuel supply system in fluid communication with the plurality of fuel injectors, and a controller in electronic communication with the plurality of fuel injectors and adapted to select delivery of vaporized fuel or liquid fuel from the plurality of fuel injectors. In one form, the system for metering vaporized fuel includes at least one capillary flow passage mounted within the fuel injector housing, each of the at least one capillary flow passage having an inlet end and an outlet end, and a heat source arranged along the at least one capillary flow passage, the heat source operable to heat the fuel within the at least one capillary flow passage to a level sufficient to change the fuel from a liquid state to a vapor state and deliver vaporized fuel from the outlet end of the at least one plurality of capillary flow passage.

In still yet another aspect, a fuel system for use in an internal combustion engine is provided. The fuel system includes a plurality of fuel injectors, each injector including at least one capillary flow passage, each of the at least one capillary flow passage having an inlet end and an outlet end, a heat source arranged along the at least one capillary flow passage, the heat source operable to heat the liquid fuel in each of the at least one capillary flow passage to a level sufficient to change from the liquid state to a vapor state and deliver a stream of vaporized fuel from the outlet end of the at least one capillary flow passages and a valve for metering vaporized fuel to the internal combustion engine, the valve located proximate to the outlet end of the at least one capillary flow passage, a liquid fuel supply system in fluid communication with the plurality of fuel injectors, and a controller to control the supply of fuel to the plurality of fuel injectors.

In a further aspect, a method of delivering fuel to an internal combustion engine is provided. The method includes the steps of supplying liquid fuel to at least one capillary flow passage of a fuel injector, causing a stream of vaporized fuel to pass through the outlet of the at least one capillary flow passage by heating the liquid fuel in the at least one capillary flow passage, and metering the vaporized fuel to a combustion chamber of the internal combustion engine through a valve located proximate to the outlet of the at least one capillary flow passage.

In a yet further aspect, an automobile is provided. The automobile includes an internal combustion engine positioned within a body, and a fuel system for fueling the internal combustion engine, the fuel system including a plurality of fuel injectors, each of the plurality of fuel injectors having an inlet and an outlet and including a fuel injector housing, a system for metering vaporized fuel to the internal combustion engine, the system positioned within the fuel injector housing, and a system for delivering an atomized stream of liquid fuel to an internal combustion engine, the system positioned within the fuel injector housing a liquid fuel supply system in fluid communication with the plurality of fuel injectors, and a controller in electronic communication with the plurality of fuel injectors and adapted to select delivery of vaporized fuel or liquid fuel from the plurality of fuel injectors.

The fuel injectors provided are effective in reducing cold-start and warm-up emissions of an internal combustion engine. Efficient combustion can be promoted by forming an aerosol of fine droplet size when the vaporized fuel condenses in air. The vaporized fuel can be supplied directly or indirectly to a combustion chamber of an internal combustion engine during cold-start and warm-up of the engine, or at other periods during the operation of the engine, and reduced emissions can be achieved due to the capacity for improved mixture control during cold-start, warm-up and transient operation.

The capillary passage can be formed within a capillary tube and the heat source can include a resistance heating element or a section of the tube heated by passing electrical current therethrough. The fuel supply can be arranged to deliver pressurized or non-pressurized liquid fuel to the flow passage. The fuel injectors can provide a stream of vaporized fuel that mixes with air and forms an aerosol having a mean droplet size of 25 μm or less.

BRIEF DESCRIPTION OF THE DRAWINGS

The invention will now be described in more detail with reference to preferred forms of the invention, given only by way of example, and with reference to the accompanying drawings, in which:

FIG. 5 is a chart illustrating the trade-off between minimizing the power supplied to the injector and minimizing the warm-up time associated with the injector for different heated masses;

FIG. 6 is a chart illustrating that maximum emission reduction may be achieved by injecting vapor only during the portion of the engine cycle in which the intake valves are open;

DETAILED DESCRIPTION OF THE PREFERRED EMBODIMENTS

Figure 1:
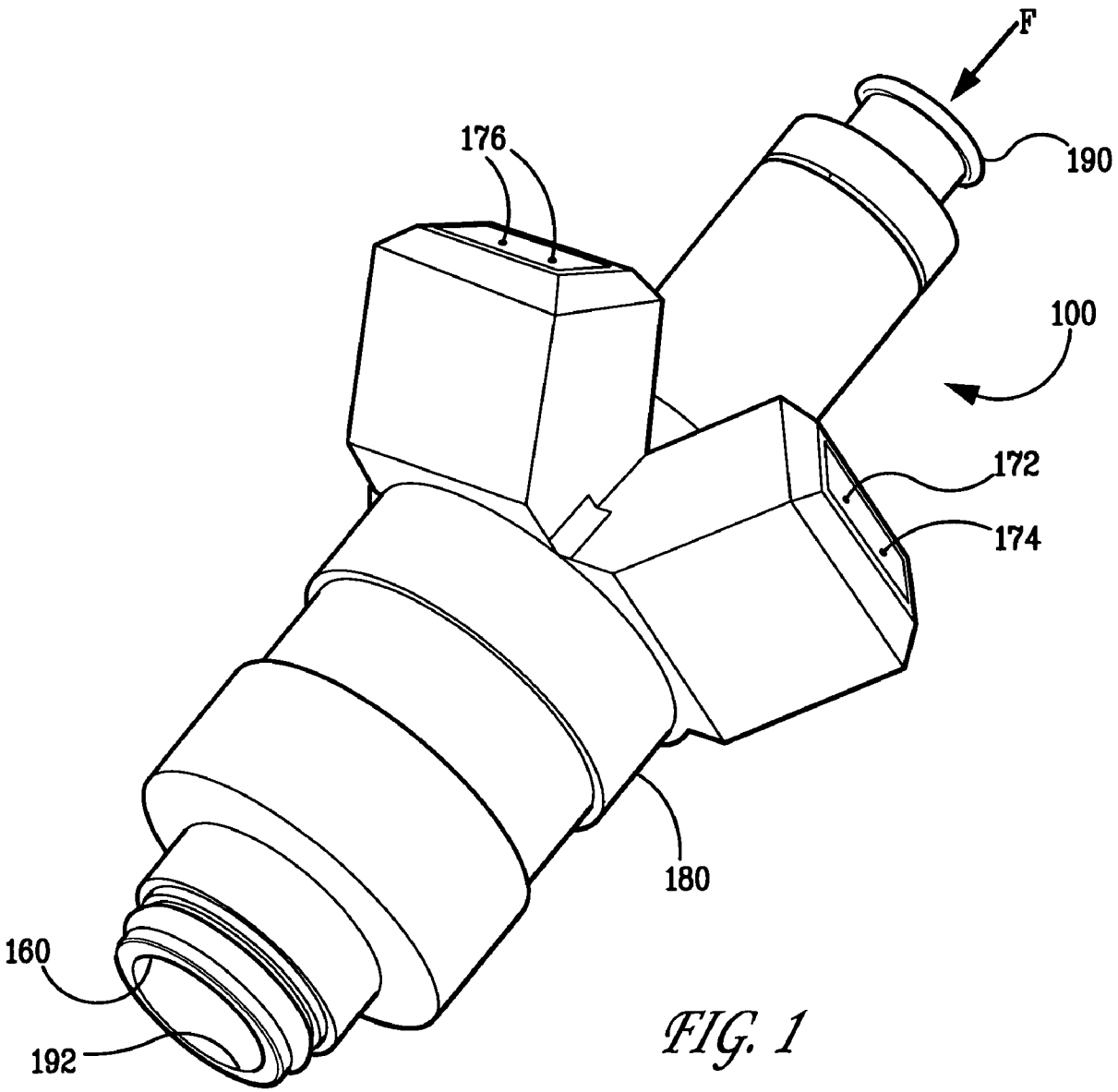
FIG. 1 shows an isometric view of another multiple capillary fuel injector having an electronically heated capillary bundle positioned upstream of a solenoid activated fuel metering valve, in accordance with another preferred form of the injector.

Reference is now made to the embodiments illustrated in FIGS. 1-12 wherein like numerals are used to designate like parts throughout.

Provided herein is a multiple capillary fuel injector with metering valve and a fuel system employing same that is useful for cold-start, warm-up and normal operation of an internal combustion engine. The fuel system includes a fuel injector having a plurality of capillary flow passages, each capillary flow passage capable of heating liquid fuel so that vaporized fuel is supplied when desired. The vaporized fuel can be combusted with reduced emissions compared to conventional fuel injector systems. The fuel delivery system of the present invention requires less power, and has shorter warm-up times than other vaporization techniques.

The injector designs provided herein are specifically aimed at meeting several automotive fuel injector design requirements including: provide an acceptable pressure drop across the injector body, provide an acceptable vaporized fuel flow rate at 100% duty cycle, provide an acceptable liquid fuel flow rate at 100% duty cycle, exhibit minimal heat-up time, possess minimal power requirement, exhibit a linear relationship between duty cycle and vaporized fuel flow and exhibit a linear relationship between duty cycle and liquid fuel flow.

As is well-known, gasoline does not readily vaporize at low temperatures. During the cold start and warm-up period of an automotive engine, relatively little vaporization of the liquid fuel takes place. As such, it is necessary to provide an excess of liquid fuel to each cylinder of the engine in order to achieve an air/fuel mixture that will combust. Upon ignition of the fuel vapor, which is generated from the excess of liquid fuel, combustion gases discharged from the cylinders include unburned fuel and undesirable gaseous emissions. However, upon reaching normal operating temperature, the liquid fuel readily vaporizes, so that less fuel is needed to achieve an air/fuel mixture that will readily combust. Advantageously, upon reaching normal operating temperature, the air/fuel mixture can be controlled at or near stoichiometry, thereby reducing emissions of unburned hydrocarbons and carbon monoxide. Additionally, when fueling is controlled at or near stoichiometry, just enough air is available in the exhaust stream for simultaneous oxidation of unburned hydrocarbons and carbon monoxide and reduction of nitrogen oxides over a three-way catalyst (TWC) system.

The fuel injector and fuel system disclosed herein injects fuel that has been vaporized into the intake flow passage, or directly into an engine cylinder, thereby eliminating the need for excess fuel during the start-up and warm-up period of an engine. The fuel is preferably delivered to the engine in a stoichiometric or fuel-lean mixture, with air, or air and diluent, so that virtually all of the fuel is burned during the cold start and warm-up period.

With conventional port-fuel injection, over-fueling is required to ensure robust, quick engine starts. Under fuel-rich conditions, the exhaust stream reaching the three-way catalyst does not contain enough oxygen to oxidize the excess fuel and unburned hydrocarbons as the catalyst warms up. One approach to address this issue is to utilize an air pump to supply additional air to the exhaust stream upstream of the catalytic converter. The objective is to generate a stoichiometric or slightly fuel-lean exhaust stream that can react over the catalyst surface once the catalyst reaches its light-off temperature. In contrast, the system and method of the present invention enables the engine to operate at stoichiometric or even slightly fuel-lean conditions during the cold-start and warm-up period, eliminating both the need for over-fueling and the need for an additional exhaust air pump, reducing the cost and complexity of the exhaust after treatment system.

As mentioned, during the cold start and warm-up period, the three-way catalyst is initially cold and is not able to reduce a significant amount of the unburned hydrocarbons that pass through the catalyst. Much effort has been devoted to reducing the warm-up time for three-way catalysts, to convert a larger fraction of the unburned hydrocarbons emitted during the cold-start and warm-up period. One such concept is to deliberately operate the engine very fuel-rich during the cold-start and warm-up period. Using an exhaust air pump to supply air in this fuel-rich exhaust stream, a combustible mixture can be generated which is burned either by auto-ignition or by some ignition source upstream of, or in, the catalytic converter. The exotherm produced by this oxidation process significantly heats up the exhaust gas and the heat is largely transferred to the catalytic converter as the exhaust passes through the catalyst. Using the system and method of the present invention, the engine could be controlled to operate alternating cylinders fuel-rich and fuel-lean to achieve the same effect but without the need for an air pump. For example, with a four-cylinder engine, two cylinders could be operated fuel-rich during the cold-start and warm-up period to generate unburned hydrocarbons in the exhaust. The two remaining cylinders would be operated fuel-lean during cold-start and warm-up, to provide oxygen in the exhaust stream.

The system and method of the present invention may also be utilized with gasoline direct injection engines (GDI). In GDI engines, the fuel is injected directly into the cylinder as a finely atomized spray that evaporates and mixes with air to form a premixed charge of air and vaporized fuel prior to ignition. Contemporary GDI engines require high fuel pressures to atomize the fuel spray. GDI engines operate with stratified charge at part load to reduce the pumping losses inherent in conventional indirect injected engines. A stratified-charge, spark-ignited engine has the potential for burning lean mixtures for improved fuel economy and reduced emissions. Preferably, an overall lean mixture is formed in the combustion chamber, but is controlled to be stoichiometric or slightly fuel-rich in the vicinity of the spark plug at the time of ignition. The stoichiometric portion is thus easily ignited, and this in turn ignites the remaining lean mixture. While pumping losses can be reduced, the operating window currently achievable for stratified charge is limited to low engine speeds and relatively light engine loads. The limiting factors include insufficient time for vaporization and mixing at higher engine speeds and insufficient mixing or poor air utilization at higher loads. By providing vaporized. fuel, the system and method of the present invention can widen the operating window for stratified charge operation, solving the problem associated with insufficient time for vaporization and mixing. Advantageously, unlike conventional GDI fuel systems, the fuel pressure employed in the practice of the present invention can be lowered, reducing the overall cost and complexity of the fuel system.

The invention provides a fuel delivery device for an internal combustion engine which includes a pressurized liquid fuel supply that supplies liquid fuel under pressure, a plurality of capillary flow passages connected to the liquid fuel supply, and a heat source arranged along the plurality of capillary flow passages. The heat source is operable to heat liquid fuel in the at least one capillary flow passage sufficiently to deliver a stream of vaporized fuel. The fuel delivery device is preferably operated to deliver the stream of vaporized fuel to one or more combustion chambers of an internal combustion engine during start-up, warm-up, and other operating conditions of the internal combustion engine. If desired, the plurality of capillary flow passages can be used to deliver liquid fuel to the engine under normal operating conditions.

The invention also provides a method of delivering fuel to an internal combustion engine, including the steps of supplying the pressurized liquid fuel to a plurality of capillary flow passages, and heating the pressurized liquid fuel in the plurality of capillary flow passages sufficiently to cause a stream of vaporized fuel to be delivered to at least one combustion chamber of an internal combustion engine during start-up, warm-up, and other operating conditions of the internal combustion engine.

A fuel delivery system according to the invention includes a plurality of capillary-sized flow passage through which pressurized fuel flows before being injected into an engine for combustion. Capillary-sized flow passages can be provided with a hydraulic diameter that is preferably less than 2 mm, more preferably less than 1 mm, and most preferably less than 0.75 mm. Hydraulic diameter is used in calculating fluid flow through a fluid carrying element. Hydraulic radius is defined as the flow area of the fluid-carrying element divided by the perimeter of the solid boundary in contact with the fluid (generally referred to as the "wetted" perimeter). In the case of a fluid carrying element of circular cross section, the hydraulic radius when the element is flowing full is $(\pi D^2/4)/\pi D = D/4$. For the flow of fluids in noncircular fluid carrying elements, the hydraulic diameter is used. From the definition of hydraulic radius, the diameter of a fluid-carrying element having circular cross section is four times its hydraulic radius. Therefore, hydraulic diameter is defined as four times the hydraulic radius.

When heat is applied along the capillary passageways, the liquid fuel that enters the flow passages is converted to a vapor as it travels along the passageway. The fuel exits the capillary passageways as a vapor, which may optionally contain a minor proportion of heated liquid fuel that has not been vaporized. Although it may be difficult to achieve 100% vaporization under all conditions due to the complex physical effects that take place, nonetheless complete vaporization is desirable. These complex physical effects include variations in the boiling point of the fuel since the boiling point is pressure dependent and pressure can vary within the capillary flow passage. Thus, while it is believed that a major portion of the fuel reaches the boiling point during heating in the capillary flow passage, some of the liquid fuel may not be heated enough to be fully vaporized with the result that a portion of the liquid fuel passes through the outlet of the capillary flow passage along with the vaporized fluid.

From the standpoint of metering a precise volume of fuel per injector pulse, it is highly desirable to meter fuel that is either in vapor form or liquid form. As may be appreciated by those skilled in the art, should two-phase flow occur in the region of the metering valve, the energy content of the fuel being metered with each pulse is exceedingly difficult to ascertain and highly variable. As such, the precise air-fuel ratio control is unattainable in the two-phase flow regime.

Each capillary-sized fluid passage is preferably formed within a capillary body such as a single or multilayer metal, ceramic or glass body. Each passage has an enclosed volume opening to an inlet and an outlet, either of which, or both, may be open to the exterior of the capillary body or may be connected to another passage within the same body or another body or to fittings. The heater can be formed using a portion of the body; for example, a section of a stainless steel or nickel-chromium alloy, such as that sold under the trademark Inconel® (a registered trademark of the International Nickel Corporation) tube or the heater can be a discrete layer or wire of resistance heating material incorporated in or on the capillary body. Each fluid passage may be any shape comprising an enclosed volume opening to an inlet and an outlet and through which a fluid may pass. Each fluid passage may have any desired cross-section with a preferred cross-section being a circle of uniform diameter. Other capillary fluid passage cross-sections include non-circular shapes such as triangular, square, rectangular, oval or other shape and the cross section of the fluid passage need not be uniform. In the case where the capillary passages are defined by metal capillary tubes, each tube can have an inner diameter of 0.01 to 3 mm, preferably 0.1 to 1 mm, most preferably 0.3 to 0.75 mm. Alternatively, the capillary passages can be defined by transverse cross sectional area of the passage, which can be $8\times10^{-5}$ to 7 $mm^2$, preferably $8\times10^{-3}$ to $8\times10^{-1}$ $mm^2$ and more preferably $7\times10^{-2}$ to $4.5\times10^{-1}$ $mm^2$. Many combinations of multiple capillaries, various pressures, various capillary lengths, amounts of heat applied to the capillary, and different cross-sectional areas will suit a given application.

The liquid fuel can be supplied to the capillary flow passage under a pressure of at least 10 psig, preferably at least 20 psig. In the case where each capillary flow passage is defined by the interior of a stainless steel or Inconel® alloy. The tube may have an internal diameter of approximately 0.020 to 0.030 inches and a length of approximately 1 to 3 inches, the fuel is preferably supplied to the capillary passageway at a pressure of 100 psig or less to achieve mass flow rates required for stoichiometric start of a typical size automotive engine cylinder (on the order of 100-200 mg/s). With two to four capillary passageways of the type described herein, a sufficient flow of vaporized fuel can be provided to ensure a stoichiometric or nearly stoichiometric mixture of fuel and air. It is important that each capillary tube be characterized as having a low thermal inertia, so that each capillary passageway can be brought up to the desired temperature for vaporizing fuel very quickly, preferably within 2.0 seconds, more preferably within 0.5 second, and most preferably within 0.1 second, which is beneficial in applications involving cold starting an engine. The low thermal inertia also could provide advantages during normal operation of the engine, such as by improving the responsiveness of the fuel delivery to sudden changes in engine power demands.

In order to meter fuel through the low thermal inertia capillary passages described herein, a valve arrangement effective to regulate vapor flow from the distal end of a fuel injector is required. Because of the small thermal mass of capillary flow passages contemplated herein, the valve arrangement used to regulate vapor flow must be designed to add minimal thermal mass to the heated system so that warm-up time and effectiveness is not degraded. Likewise, the surface area wetted by the fuel must be minimized so that the vaporized fuel does not re-condense on contact and jeopardize performance.

The preferred forms described below allow for the pulsed delivery of fuel vapor and provide the capacity to switch over to liquid fuel injection. The vapor flow path through the capillary flow passages is actively heated such that the working fluid is in the vapor phase upon coming into contact with the valve. It is preferred that the valve itself not be actively heated.

Figure 2:
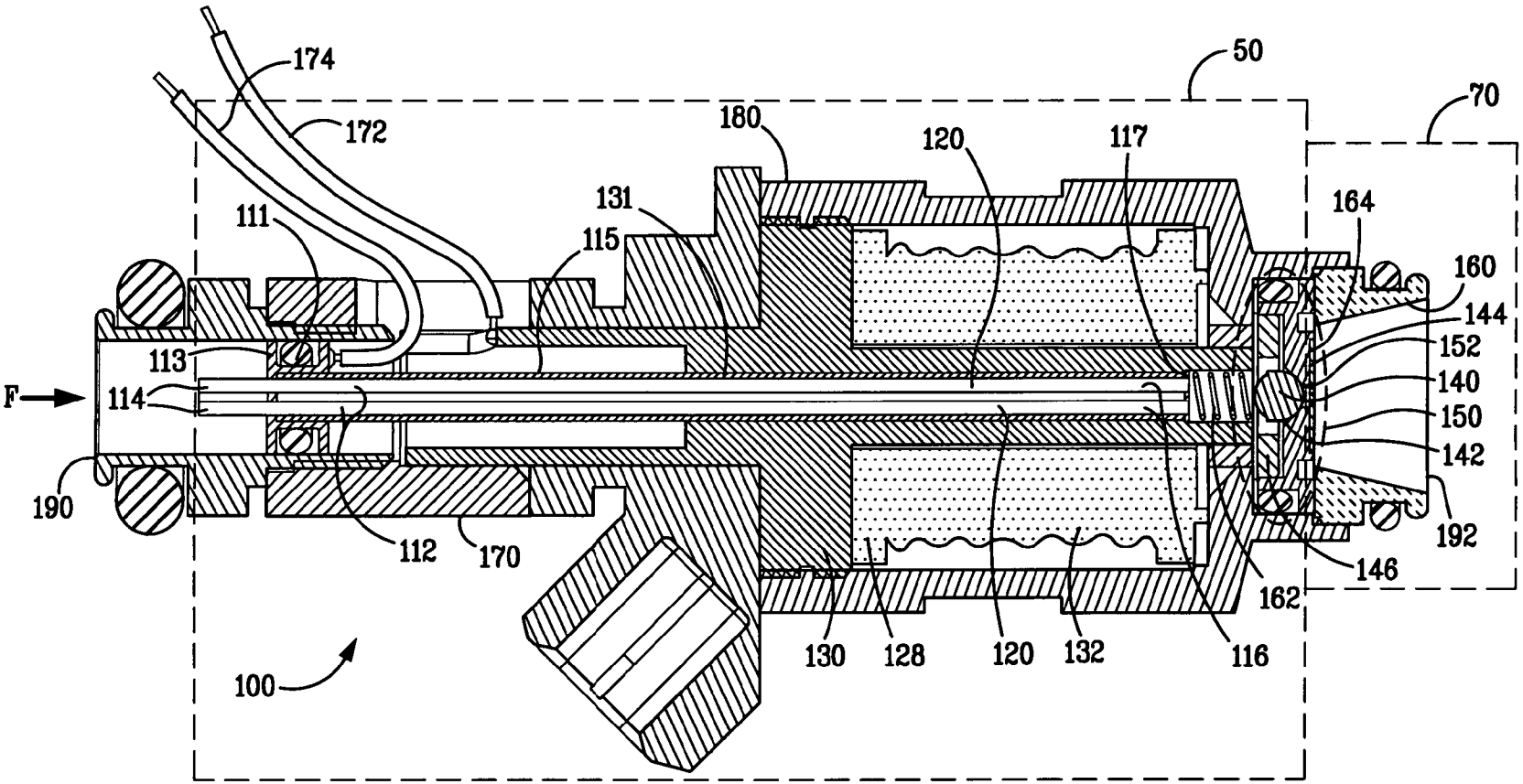
FIG. 2 is a partial cross-sectional side view of the multiple capillary fuel injector of FIG. 1.
Figure 3:
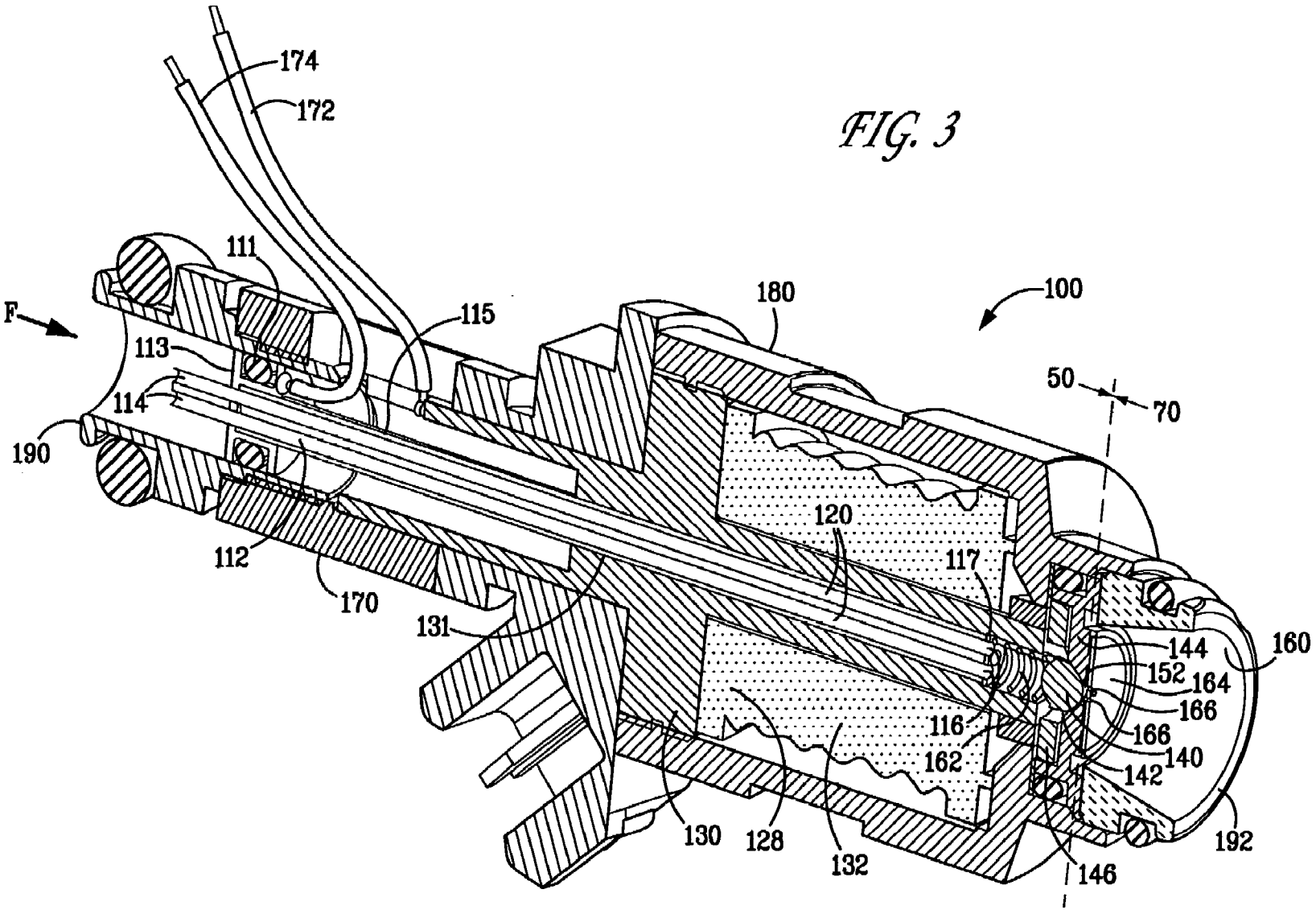
FIG. 3 is an isometric partial cross-sectional view of the multiple capillary fuel injector of FIG. 1.

FIGS. 1-4 present a capillary fuel injector 100 for vaporizing liquid fuel drawn from a source of liquid fuel F, in accordance with a preferred form of the present invention. The capillary fuel injector 100 includes a fuel injector housing 180, a system for metering vaporized fuel 50 to a combustion chamber of an internal combustion engine, the system 50 positioned within fuel injector housing 180, and a system for delivering an atomized stream of liquid fuel 70, positioned downstream of the system for metering vaporized fuel 50. As shown in FIGS. 1-3, the system for delivering an atomized stream of liquid fuel 70 relies upon the system for metering vaporized fuel 50, located upstream, for feeding liquid fuel thereto and metering same. As will be described in more detail below, in the liquid mode of injector operation, no vaporization occurs within the system for metering vaporized fuel 50.

Fuel injector 100 is operable to transition from metering vaporized fuel to delivering an atomized stream of liquid fuel. Fuel injector 100 has an inlet 190 for admitting fuel F and an outlet 192. In terms of form and fit, it may be designed in a manner similar to conventional port fuel injectors, so as to be substantially interchangeable therewith.

As shown in detail in FIGS. 2 and 3, one form of the system for metering vaporized fuel 50 possesses a ball-in-cone valve assembly 144. The system for metering vaporized fuel 50 also includes a capillary bundle 115 having a plurality of capillary flow passages 112, each having an inlet end 114 and an outlet end 116, with the inlet end 114 in fluid communication with the liquid fuel source F for introducing the liquid fuel in a liquid state into the capillary flow passages 112. The capillary bundle 115 is positioned within the central bore of the injector housing 180 and intermediate injector housing 130.

Capillary bundle 115 is shown having a plurality of capillary flow passages 112, each having an inlet end 114 positioned by inlet O-ring retainer 113 and an outlet end 116 terminating in a disc 117 and held in position by intermediate injector housing 130. The inlet retainer 113 is held in place by the rubber O-ring 111 that seals against fuel flow from source F that is in fluid communication with inlet end 114. A plastic coupling 170 attaches the inlet section 190 and inlet of the capillary bundle 115 to the intermediate injector housing 130. In one preferred embodiment, the capillary bundle 115 is surrounded by a ceramic sleeve 131. It is contemplated that, when fuel injectors of the type described herein are produced in high volume, rubber O-ring 111 may be replaced by a suitably compliant metal ring that would be affixed by laser welding or the like. As may be appreciated, it is necessary that such a ring be compliant in view of the fact that capillary bundle 115 incurs an element of growth during heating.

The system for metering vaporized fuel 50 also includes a heat source 120 arranged along each capillary flow passage 112. As is preferred, each heat source 120 is provided by forming capillary flow passage 112 from a tube of electrically resistive material, a portion of each capillary flow passage 112 forming a heater element when a source of electrical current is connected to the tubes as discussed herein below.

Fuel injector 100 advantageously functions in three distinct modes: a full vaporization mode, a flash vaporization mode and an atomized liquid mode. In the full vaporization mode, each heat source 120 is operable to heat the liquid fuel in each capillary flow passage 112 to a sufficient level to change from a liquid state to a vapor state and deliver a stream of vaporized fuel from the outlet end 116 of each capillary flow passage 112. As may be appreciated, this method of vapor delivery within the body of the injector minimizes the volume of material that comes into contact with the vaporized fuel and, therefore, also minimizes the thermal mass that must be heated in order to prevent premature condensation of the vapor. Under conditions wherein sufficient pressure drop exists, advantageously, each heat source 120 may heat the liquid fuel in each capillary flow passage 112 to a sufficient level so that flash vaporization occurs on exiting the orifice 152 and results in a stream of vaporized fuel at orifice 152.

In the flash vaporization mode of operation, the fuel is not heated to a fully vaporized state within capillary passage 112. As will be described in more detail below, the prevailing pressure drop across ball-in-cone valve assembly 144 is utilized to vaporize a liquid fuel that has been heated to a point below the temperature required to vaporize the fuel within capillary passage 112. As will be appreciated by those skilled in the art, this mode of operation may be advantageously used during part-load or idle conditions wherein manifold vacuum is relatively high, creating the requisite pressure drop to produce flash vaporization.

Capillary bundle 115 may consist of one or more thin-walled capillary flow passages 112. In this embodiment, they are of about 0.028-0.029 in. (0.07 cm) ID and 0.032 in. (0.08 cm) OD. Capillary flow passages 112 may be constructed from stainless steel or annealed Inconel® 600 alloy tubes, each having a heated length 120 of from about 1.25 in. (3.17 cm) to about 2.50 in. (6.35 cm). When current is supplied to capillary bundle 115, the heated length of each capillary passage 112 becomes hot.

Currently, a preferred version of bundle 115 is comprised of four tubes of 18/8 stainless steel (AISI Type 304) having a 0.029 in. (0.074 cm) ID, a 0.032 in. (0.08 cm) OD, and a heated length of 2.00 in. (5.1 cm). Optimum power level for the bundle of four is in the range of 90-120 watts per 100-150 mg/sec of average fuel flow. The ceramic tube 131 is made of 94% alumina with an ID of 0.085 in. (0.22 cm) encompassing the bundle 115 and an OD of 0.104 in. (0.26 cm). This component provides both electrical and thermal insulation for the capillary tubes, but the primary purpose is to provide electrical insulation from the housing 130.

Figure 4:
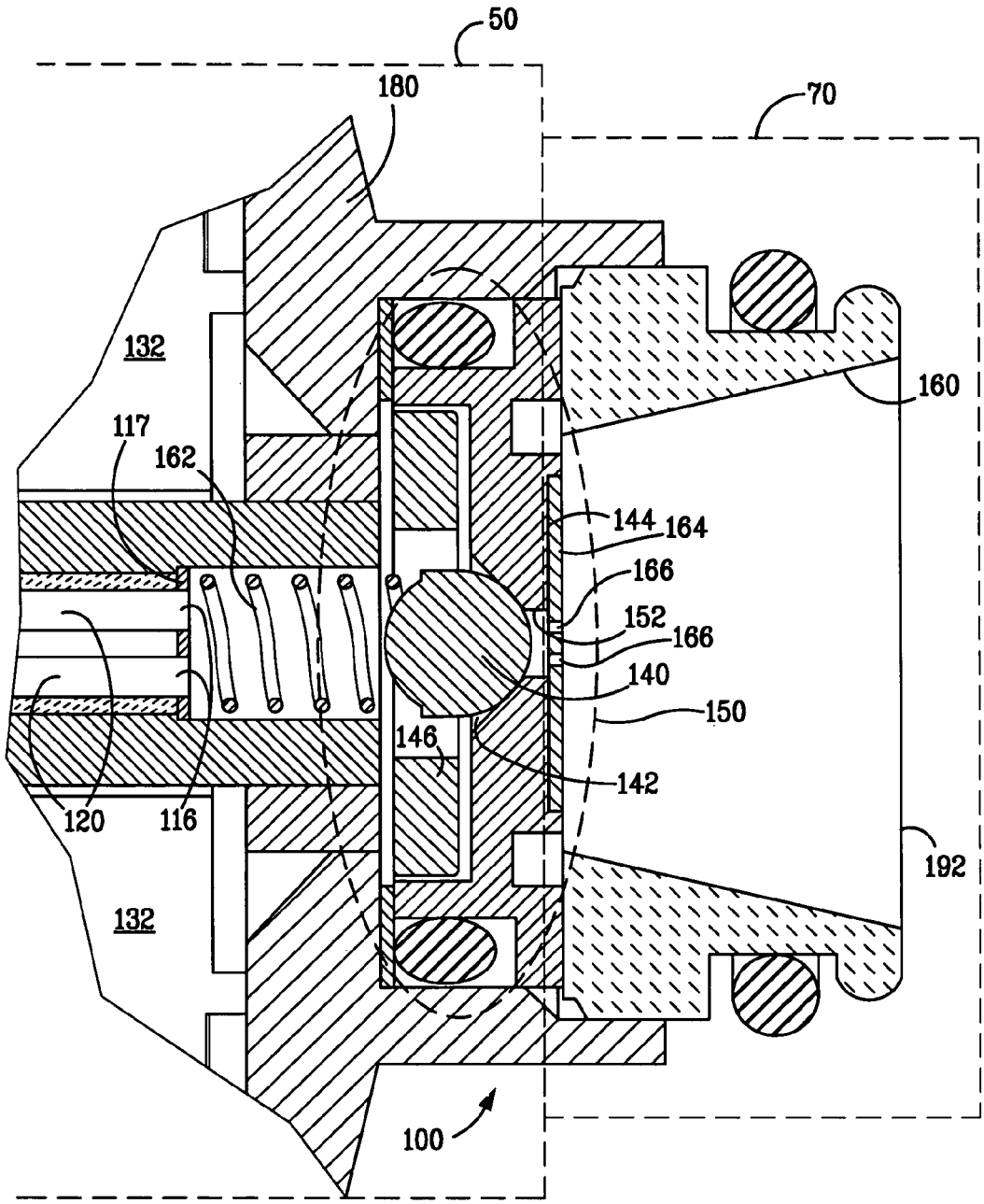
FIG. 4 is an enlarged partial cross-sectional view showing in detail the valve assembly of the multiple capillary fuel injector of FIG. 1.

Referring, in particular, to FIGS. 3-4, a low-mass ball valve assembly 144 is operated by solenoid 128. Solenoid 128 has coil windings 132 that may be connected to electrical connectors in any conventional manner. When the coil windings 132 are energized, a magnetic field is directed through plate 146, which is connected to ball 140, thereby causing it to lift from conical sealing surface 142, exposing an orifice 152, and allowing fuel to flow. When electricity is cut off from the coil windings 132, a spring 162 returns the plate 146 and attached ball 140 to their original position. The spring 162 is dimensioned such that the force of the spring 162 pushing the ball 140 against the conical sealing surface 142 of the injector 100 is sufficient to block the flow of pressurized fuel in the injector 100.

In an alternate embodiment, a solenoid element (not shown) could be drawn into the center of coil windings 132 to lift ball 140, which could be affixed to the solenoid element. Movement of the solenoid element, caused by applying electricity to the coil windings 132, would cause the ball 140 to be drawn away from conical sealing surface 142, exposing an orifice 152, and allowing fuel to flow. Again, when electricity is cut off from the coil windings 132, a spring 162 returns the ball 140 to its original position.

Upon exiting the outlet ends 116 of capillary passages 112, fuel flow is directed toward ball valve assembly 144 of the fuel injector 100. As with many conventional fuel injectors, the metering section 150 consists of a solenoid operated ball-in-cone metering valve assembly 144. The act of actuating the solenoid 128 to move the plate 146 and ball 140 assembly between the open and closed position serves to meter the flow of fuel exiting the injector 100.

Upon exiting the orifice 152, the fuel flows through the system for delivering an atomized stream of liquid fuel 70. The system for delivering an atomized stream of liquid fuel 70 includes an atomizing plate 164, having a plurality of atomizing orifices 166, and a conical chimney section 160 to create the desired spray atomization and spray angle in the case of substantially liquid fuel sprays. The angle of the cone can span a wide range of values provided that the ball forms a seal with the surface of the cone. Chimney section 160 also serves to allow the injector 100 to satisfy overall length requirements of conventional port fuel injectors. As may be appreciated, proper operation of injector 100 is possible without the inclusion of the chimney section 160.

As may be appreciated, a fundamental challenge associated with making electrical connections is ensuring a good connection at the outlet ends 116 of the capillary passages 112 of the capillary bundle 115. Other methods are believed to have utility and are within the scope of subject matter disclosed herein. For example, one wire 172 may be connected to the core material which is in electrical contact with the capillary passages 112 near the outlet ends 116. Another wire 174 is then connected to a metal piece (not the core) that is in electrical contact with the inlet ends 114 of the capillary passages 112. In another method for achieving a good electrical connection, an insulated wire is included as part of the capillary bundle 115. In this method, the electrical connections are made prior to inserting the capillary bundle 115 into the injector 100. As previously described, the capillary bundle 115 is surrounded by insulating material (e.g., ceramic tube 131). The insulating material is then surrounded by an electrically conducting tube, which connects to the disk 117 that is at the outlet ends 116 of the capillary bundle 115. Through this configuration, an electrical connection made at the inlet ends 114 of the capillary passages 112 results in the supply of electricity to the outlet ends 116 of the capillary bundle 115.

One preferred method of making electrical connections to the capillary bundle 115 in order to provide heat sources 120 is to use a metallic O-ring retainer 113 and a metallic disc 117 that are brazed or otherwise electrically connected to the capillaries 112. A wire is attached to intermediate injector housing 130 that makes electrical contact to disc 117 and another wire attached to O-ring retainer 113.

FIG. 1 illustrates an outside isometric view of a capillary fuel injector 100. Wires 176 that connect to the solenoid 128 and wires 172 and 174 that connect to the capillary bundle 115 illustrated in FIG. 1 are terminated in spade lugs. Separate connector bodies are used and disposed at approximately 90 degrees on the injector housing 180. Thus, the capillary heaters may be physically disconnected by disconnecting a plug without disabling the solenoid that operates the fuel injector ball valve.

As may be appreciated, the ball valve assembly 144 allows vaporized fuel flow to be metered through a metering section 150 having low thermal inertia and minimal wetted area. These features are useful for ensuring that vaporized fuel delivery is achieved with a minimal temporal delay after initial power-up and also mitigate against premature recondensation of fuel vapor as it exits the injector 100. This ensures that minimal droplet sizes are achieved during steady-state operation of the injector 100 when operated in the fuel vaporizer mode. Nevertheless, it should be readily recognized that the ball valve assembly 144 depicted in FIGS. 2-4 represents one of several valve designs that can be used in the design of the injectors of the present invention. The critical features of a suitable valve design used to meter fuel vapor are the combination of low thermal inertia and minimal wetted area. Other suitable valve designs possessing these critical features are disclosed in U.S. application Ser. No. 10/342,267, filed on Jan. 15, 2003, the contents of which are hereby incorporated by reference for all that is disclosed.

Referring to FIGS. 2-3, the electric circuit used to supply heat to the capillary passages 112 consists of a power supply (not shown) and a controller 2050 (see FIG. 7), capillary bundle 115, and wires 172 and 174 attached to the capillary bundle 115 to allow resistance heating of heated section 120 of the capillary passages 112.

To achieve vaporization in a cold engine environment, there exists a tradeoff between minimizing the power supplied to the injector for heating and minimizing the associated warm-up time, as shown in FIG. 5. As may be appreciated, the power available to heat the injector is limited to the available battery power, while the injector warm-up time is limited by consumer performance requirements. As shown in FIG. 5, the power requirement during the initial heat-up period can be traded-off for even quicker heat-up time; for example, a start-up power of 300 W will bring the injector to target temperature in approximately 160 ms.

In addition to the design and performance requirements outlined above, it is also necessary to have some degree of control over the fuel/air ratio as necessitated by the exhaust after-treatment scheme and/or the start-up control strategy. At a minimum, the fuel injector must have the capacity to accommodate the requisite turndown ratio, from cranking to idle to other engine operating conditions. However, in some forms, maximum emission reduction is achieved by injecting vapor only during the portion of the engine cycle in which the intake valves are open. Such an injection profile is illustrated in FIG. 6, together with the approximate times associated with each portion of a four-stroke cycle. As indicated, at 1500 rpm, open valve injection is achieved through control of the vapor flow rate such that injection occurs for 20 ms followed by a 60 ms period in which little to no vapor is delivered to the engine.

Prior valve designs used to regulate the flow of fuel injectors have been known to produce an undesirable increase in the thermal mass, which is the mass that must be heated in order to achieve sufficient temperature to vaporize the liquid. This increase in thermal mass is undesirable because it increases the warm-up time of the injector (see FIG. 5) and, as such, compromises the vapor quality issued from the injector during startup and/or transient operation.

Figure 7:
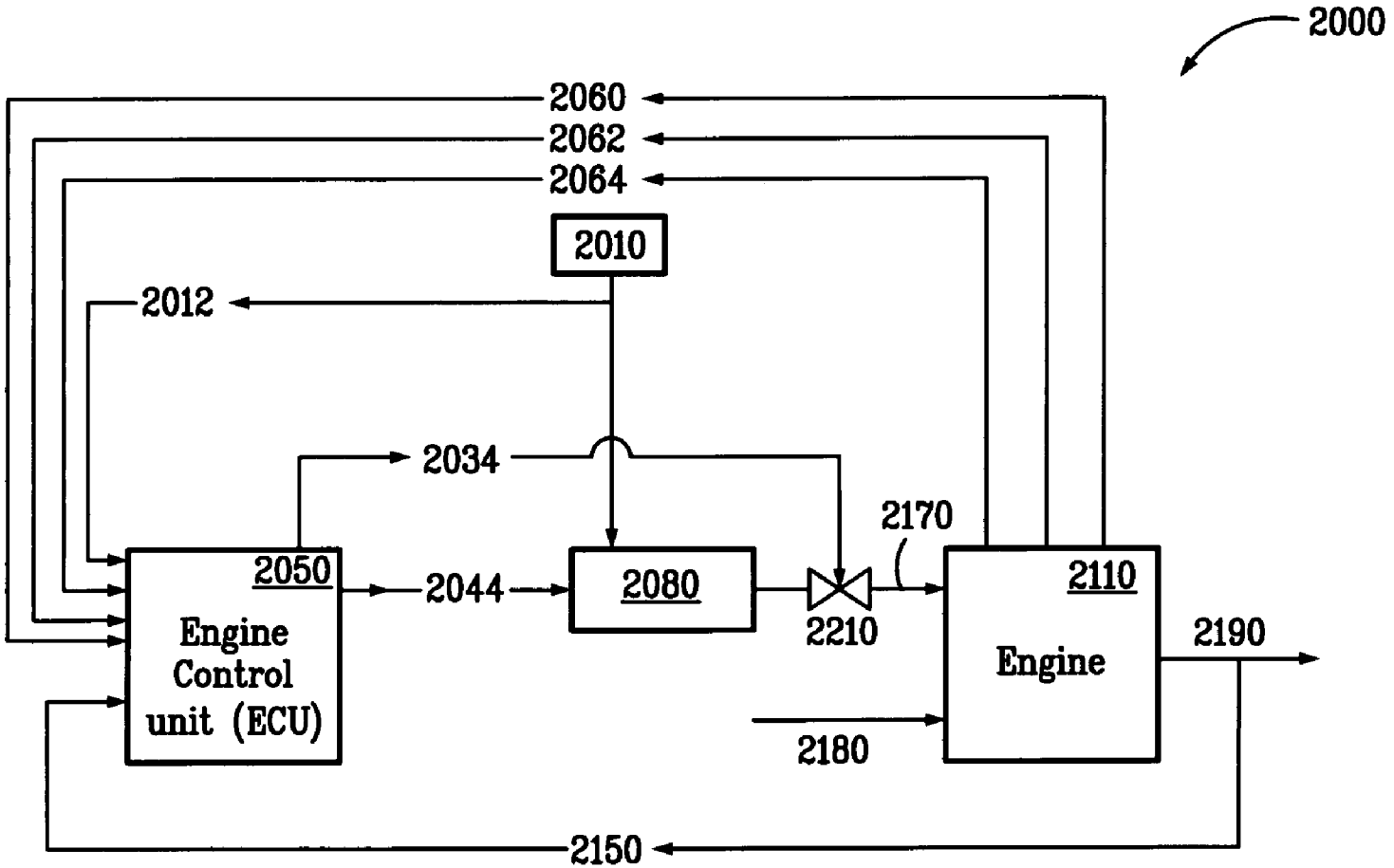
FIG. 7 is a schematic of a fuel delivery and control system, in accordance with a preferred form.

Referring now to FIG. 7, an exemplary schematic of a control system 2000 is shown. Control system 2000 is used to operate an internal combustion engine 2110 incorporating fuel supply valve 2210 in fluid communication with a liquid fuel supply 2010 and capillary flow passages 2080. The control system includes a controller 2050, which typically receives a plurality of input signals from a variety of engine sensors such as engine speed sensor 2060, intake manifold air thermocouple and intake pressure sensor 2062, coolant temperature sensor 2064, exhaust air-fuel ratio sensor 2150, fuel supply pressure 2012, etc. In operation, the controller 2050 executes a control algorithm based on one or more input signals and subsequently generates an output signal 2034 to the fuel supply valve 2210, and a heating power command 2044 to a power supply which delivers power to heat to the capillaries 2080.

In operation, the system herein proposed can also be configured to feed back heat produced during combustion through the use of exhaust gas recycle heating, such that the liquid fuel is heated sufficiently to vaporize the liquid fuel as it passes through the capillary flow passages 2080 reducing or eliminating or supplementing the need to electrically or otherwise heat the capillary flow passages 2080.

As disclosed in U.S. application Ser. No. 10/284,180, filed on Oct. 31, 2002, the contents of which are incorporated by reference in their entirety, the resistance of the capillary flow passage is used as a feedback measurement to determine the appropriate adjustment in power to the capillary flow passage to maintain the target ratio of measured resistance to cold capillary flow passage resistance ($R/R_o$). This technique is particularly advantageous when used to ensure that high quality vapor is injected into the engine throughout the cold-start and warm-up period. An analog control algorithm may be employed using a PID controller wherein the resistance of the capillary flow passage in a previous time-step is used as the basis for a finite correction to the power supplied to the capillary flow passage in the current time-step. Through such an analog control methodology, the power supplied to the capillary flow passage may span the entire spectrum from zero to the maximum allowable value. However, ideally, the power to the capillary flow passage will be significantly less than the available power such that the control algorithm can effectively respond to sudden changes.

A preferred control strategy advantageously employs several different modes, including: fully vaporized fuel (primarily during cranking and start-up of the engine), heated fuel that flash vaporizes as it undergoes the sudden pressure drop in exiting the fuel injector into the intake manifold, primarily during cold start idle and first initial transient, and unheated liquid fuel, primarily for normal operating following cold-start and initial warm-up.

As disclosed in U.S. application Ser. No. 10/284,180, to design the set points required to implement this strategy, knowledge of the distillation (or vapor) curve for the fuel of interest is required. A vapor curve for commercial gasoline at atmospheric conditions (1 bar) normally ranges from an initial boiling point around (IBP) 20° C. to a final boiling point (FBP) around 200° C. The temperature at which 50% of the fuel is vaporized ($T_{50}$) typically falls in the 80° C. to 120° C. range. This vapor curve shifts to lower temperatures at sub-atmospheric conditions (such as in the intake manifold of an operating engine), and to higher temperatures at elevated pressures (such as the fuel pressure in the fuel system and fuel injector).

For a typical commercial gasoline, the temperature at which 50% is vaporized is close to 160° C. in the fuel injector, but may be as low as 80° C. in the intake manifold during idling. If the fuel in the fuel injector is maintained at 100° C., only a very small fraction (<5%) will be vaporized. As this fuel leaves the injector nozzle and enters the intake manifold at idling conditions (0.4 bar), most of the liquid fuel will flash vaporize, since the ambient pressure is now lower than the 75% vapor pressure.

During cranking, the intake manifold pressure is atmospheric and thus the fuel pressure in the fuel injector is only four times higher than the intake manifold pressure. As such, the fuel temperature is deliberately controlled to levels well above the FBP at 4 bar. This is done to quickly heat up the capillaries and to ensure that the engine is supplied with high quality vaporized fuel for start-up. During cold-start idle, the intake manifold pressure is sub-atmospheric (0.4 bar) and thus the fuel pressure in the fuel injector is about ten times higher than the intake manifold pressure. In this case, the fuel temperature is lowered so that most of the fuel in the injector remains liquid. As the fuel exits the injector into the sub-atmospheric conditions in the intake manifold, most of the fuel flash vaporizes.

Following cold-start and initial engine warm-up, the fuel temperature is further reduced below the IBP at 4 bar pressure. Consequently, all fuel in the injector is in liquid phase and the fuel mass flow capacity of the injector can support the entire engine operating range, up to full load. A fraction (up to 50% at idle) of the fuel will still flash vaporize as it enters the intake manifold. The slightly elevated temperature in the capillary flow passage can also be beneficial for inhibiting deposit build up since some fuel additives designed to keep engine components deposit free are temperature sensitive and do not function at low temperatures. For fully-warmed operation, the capillary is left unheated and the fuel injector functions much like a conventional port fuel injector.

As will be appreciated, the preferred forms of fuel injectors depicted in FIGS. 1 through 4 may also be used in connection with another embodiment of the present invention. Referring again to FIG. 1, injector 100 may also include means for cleaning deposits formed during operation of injector 100. As envisioned, the means for cleaning deposits includes placing each capillary flow passage 112 in fluid communication with a solvent, enabling the in-situ cleaning of each capillary flow passage 112 when the solvent is introduced into each capillary flow passage 112. While a wide variety of solvents have utility, the solvent may comprise liquid fuel from the liquid fuel source. In operation, the heat source should be phased-out over time or deactivated during the cleaning of capillary flow passage 112.

Referring again to FIG. 1, the heated capillary flow passages 112 of fuel injector 100 can produce vaporized streams of fuel, which condense in air to form a mixture of vaporized fuel, fuel droplets, and air commonly referred to as an aerosol. Compared to conventional automotive port-fuel injectors that deliver a fuel spray comprised of droplets in the range of 150 to 200 μm Sauter Mean Diameter (SMD), the aerosol has an average droplet size of less than 50 μm SMD, preferably less than 25 μm SMD and still more preferably less than 15 μm SMD. Thus, the majority of the fuel droplets produced by the heated capillary injectors according to the invention can be carried by an air stream, regardless of the flow path, into the combustion chamber.

The difference between the droplet size distributions of a conventional injector and the fuel injectors disclosed herein is particularly critical during cold-start and warm-up conditions. Specifically, using a conventional port-fuel injector, relatively cold intake manifold components necessitate over-fueling such that a sufficient fraction of the large fuel droplets, impinging on the intake components, are vaporized to produce an ignitable fuel/air mixture. Conversely, the vaporized fuel and fine droplets produced by the fuel injectors disclosed herein are essentially unaffected by the temperature of engine components upon start-up and, as such; eliminate the need for over-fueling during engine start-up conditions. The elimination of over-fueling combined with more precise control over the fuel/air ratio to the engine afforded through the use of the fuel injectors disclosed herein results in greatly reduced cold start emissions compared to those produced by engines employing conventional fuel injector systems. In addition to a reduction in over-fueling, it should also be noted that the heated capillary injectors disclosed herein further enable fuel-lean operation during cold-start and warm-up, which results in a greater reduction in tailpipe emissions while the catalytic converter warms up.

Fuel can be supplied to the injectors disclosed herein at a pressure of less than 100 psig, preferably less than 70 psig, more preferably less than 60 psig and even more preferably less than 45 psig. It has been shown that this embodiment produces vaporized fuel that forms a distribution of aerosol droplets that mostly range in size from 2 to 30 μm SMD with an average droplet size of about 5 to 15 μm SMD, when the vaporized fuel is condensed in air at ambient temperature. The preferred size of fuel droplets to achieve rapid and nearly complete vaporization at cold-starting temperatures is less than about 25 μm. This result can be achieved by applying approximately 100 to 400 W, e.g., 200 W of electrical power, which corresponds to 2-3% of the energy content of the vaporized fuel to the capillary bundle. Alternatives for heating the tube along its length could include inductive heating, such as by an electrical coil positioned around the flow passage, or other sources of heat positioned relative to the flow passage to heat the length of the flow passage through one or a combination of conductive, convective or radiative heat transfer. After cold-start and warm-up, it is not necessary to heat the capillary bundle and the unheated capillaries can be used to supply adequate volumes of liquid fuel to an engine operating at normal temperature. After approximately 20 seconds (or preferably less) from starting the engine, the power used to heat the capillaries can be turned off and liquid injection initiated, for normal engine operation. Normal engine operation can be performed by liquid fuel injection via continuous injection or pulsed injection, as those skilled in the art will readily recognize.

The fuel injectors disclosed herein can be positioned in an engine intake manifold at the same location as existing port-fuel injectors or at another location along the intake manifold. The fuel injectors disclosed herein provide advantages over systems that produce larger droplets of fuel that must be injected against the back side of a closed intake valve while starting the engine. Preferably, the outlet end of the fuel injector is positioned flush with the intake manifold wall similar to the arrangement of the outlets of conventional fuel injectors.

EXAMPLES

Laboratory bench tests were performed using gasoline supplied at constant pressure with a micro-diaphragm pump system for the capillaries described below. Peak droplet sizes and droplet size distributions were measured using a Spray-Tech laser diffraction system manufactured by Malvern. Droplet sizes are given in Sauter Mean Diameter (SMD). SMD is the diameter of a droplet whose surface-to-volume ratio is equal to that of the entire spray and relates to the spray's mass transfer characteristics.

Figure 8:
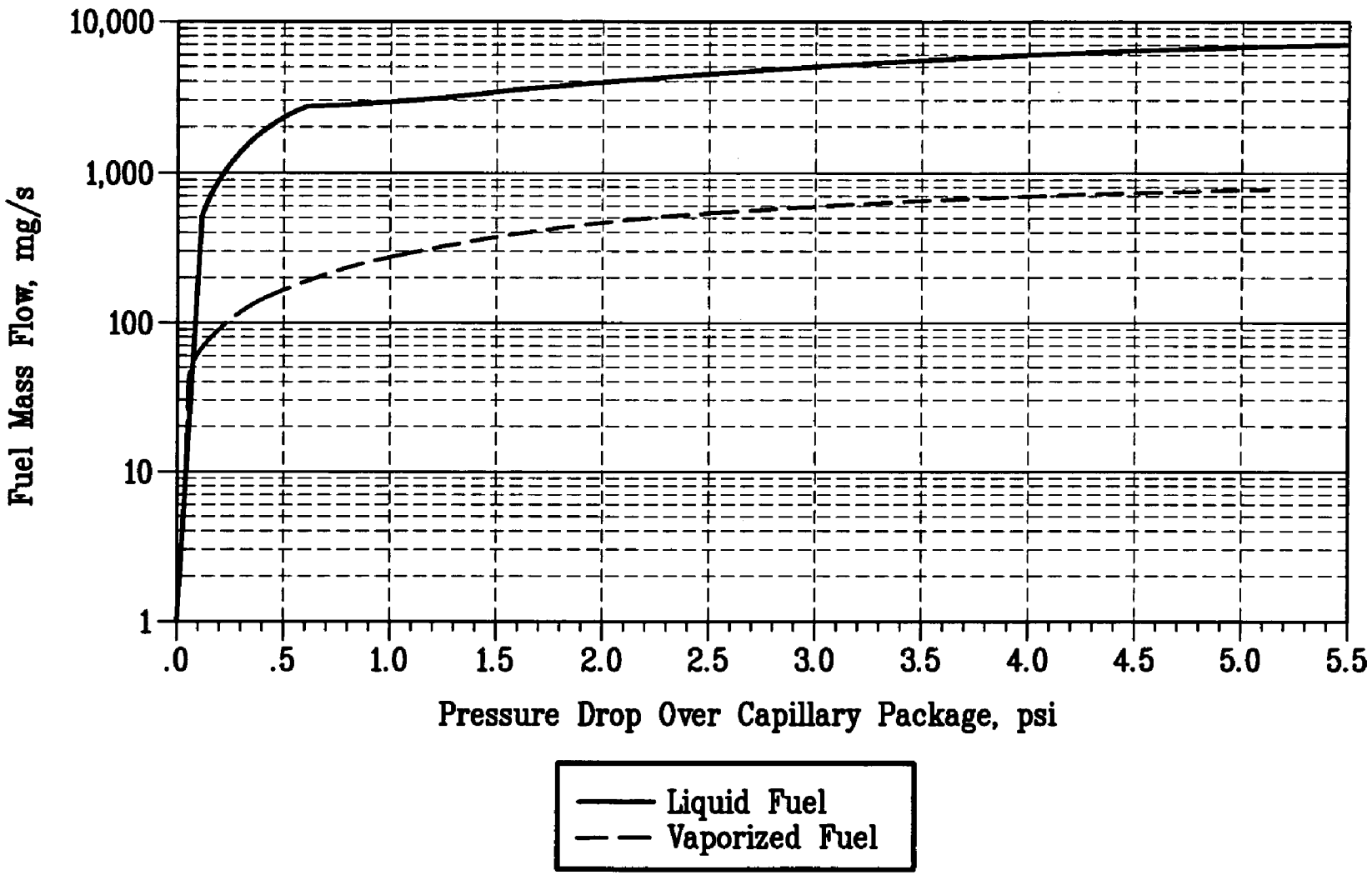
FIG. 8 presents the liquid mass flow rate and vapor mass flow rate of fuel through a bundle of four, two-inch capillaries as a function of the pressure drop across the capillary bundle.

FIG. 8 presents the liquid mass flow rate and vapor mass flow rate of fuel through a bundle of four 2.0" capillaries as a function of the pressure drop across the capillary bundle. In FIG. 8, flow through "thin wall" (0.032 OD, 0.028-0.029 ID) capillaries is depicted, each capillary constructed of 304 stainless steel, although it should be readily recognized that similar results are achievable with Inconel® 600 alloy. A critical difference between the use of stainless steel 304 and Inconel® 600 alloy in this application is the electrical resistivity of each material. Specifically, Inconele® 600 alloy has a higher resistivity than stainless steel 304 and, therefore, is better suited to the present application where higher resistivity is essential for compatibility with the electrical circuit used to supply heat to the capillaries. By bundling 2-4 capillaries into a package, the resulting flow capacity is large enough to support even high flow injectors while maintaining more than 90% of the pressure drop across the metering orifice plate. Also as shown, at less than 4.5 psi pressure drop, a typical capillary bundle can deliver 6 g/s of liquid fuel and 0.7 g/s of vaporized fuel. This means that with a fuel pressure of 45 psig, the pressure drop over the capillary bundle must be less than 4.5 psi to maintain more than 90% of the total pressure drop across the injector metering plate.

Figure 9:
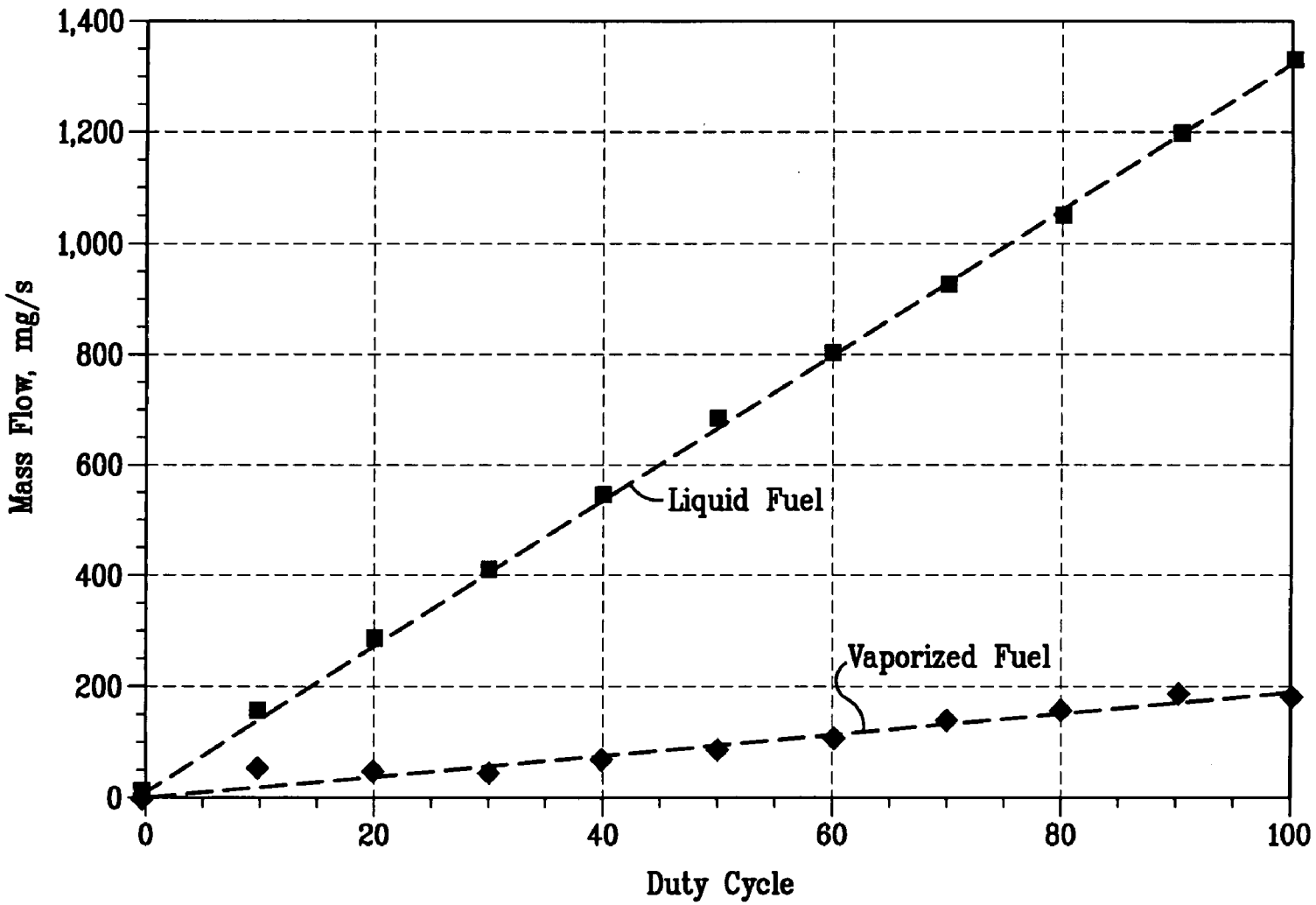
FIG. 9 presents mass flow rate as a function of injector duty cycle for a bundle of four, two-inch capillaries.

As indicated in FIG. 9, a capillary injector having a bundle of four, 2-inch capillaries of the type described above meters both liquid and vaporized fuel using the conventional and well-proven pulse width modulation technology. At this design point, the results in FIG. 9 indicate that the liquid and vapor flow rate requirements for most automotive port fuel injection applications can be met with 2-4 thin-walled, 2.0" capillaries. Additionally, for any given duty cycle, the mass-flow difference between liquid and vapor operation is on the order of 7:1. This is a fundamental difference between vapor and liquid operation and could be considered for OBD monitoring.

Figure 10:
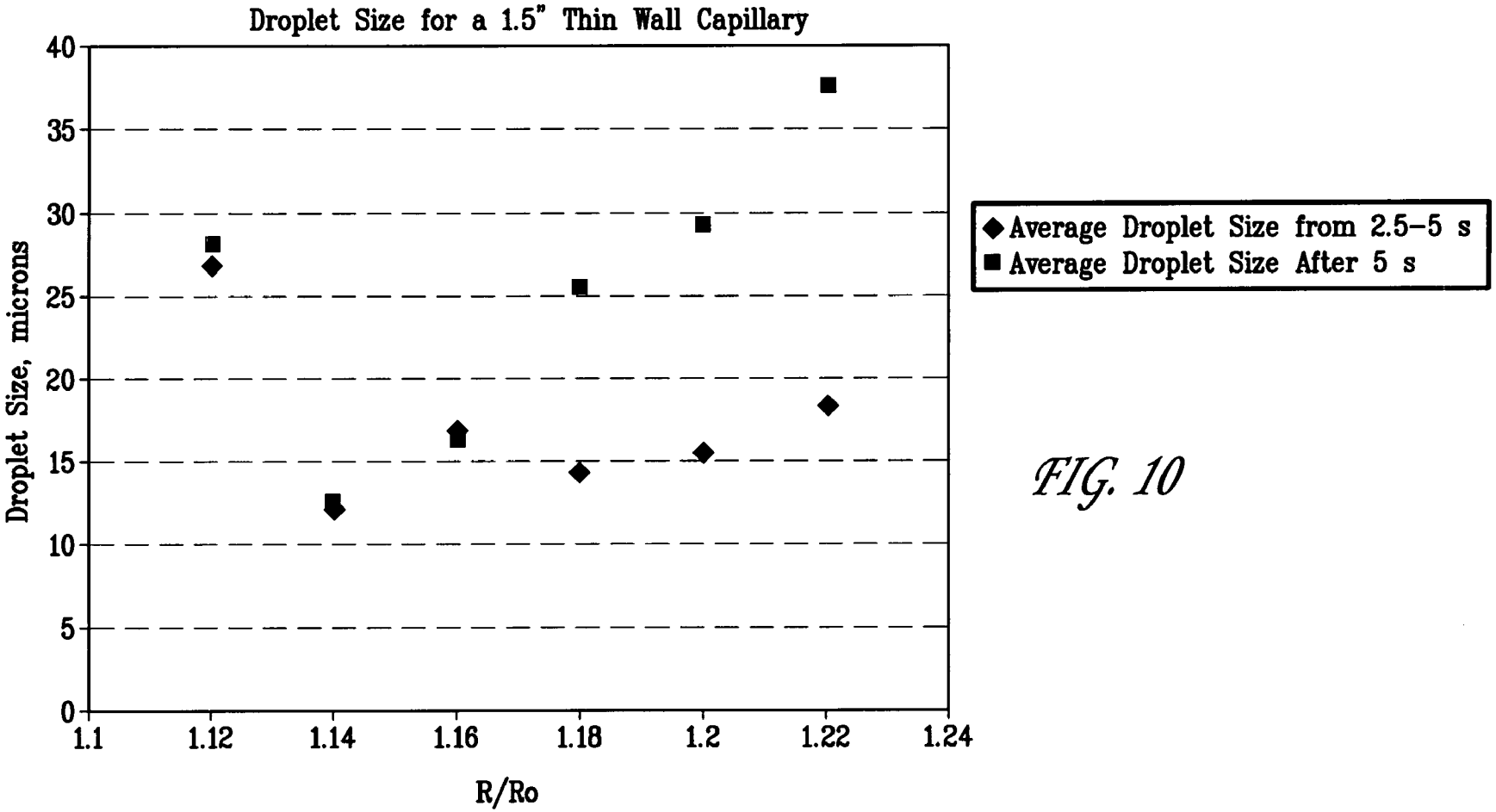
FIG. 10 presents fuel droplet size (SMD in microns) as a function of the resistance set-point of a 1.5" thin wall capillary.

FIG. 10 presents fuel droplet size (SMD in microns) as a function of the resistance set-point of a 1.5" thin wall capillary. The results indicate that the droplet sizes vary significantly with the temperature set-point of the capillary expressed as the ratio of the heated capillary resistance (R) to the cold capillary resistance ($R_o$). However, the preferred range for the temperature set-point of is the stainless steel capillary is around an $R/R_o$ value of 1.12 to 1.3. For stainless steel, this range corresponds to a bulk capillary temperature on the order of 140° C. to 220° C.

Figure 11:
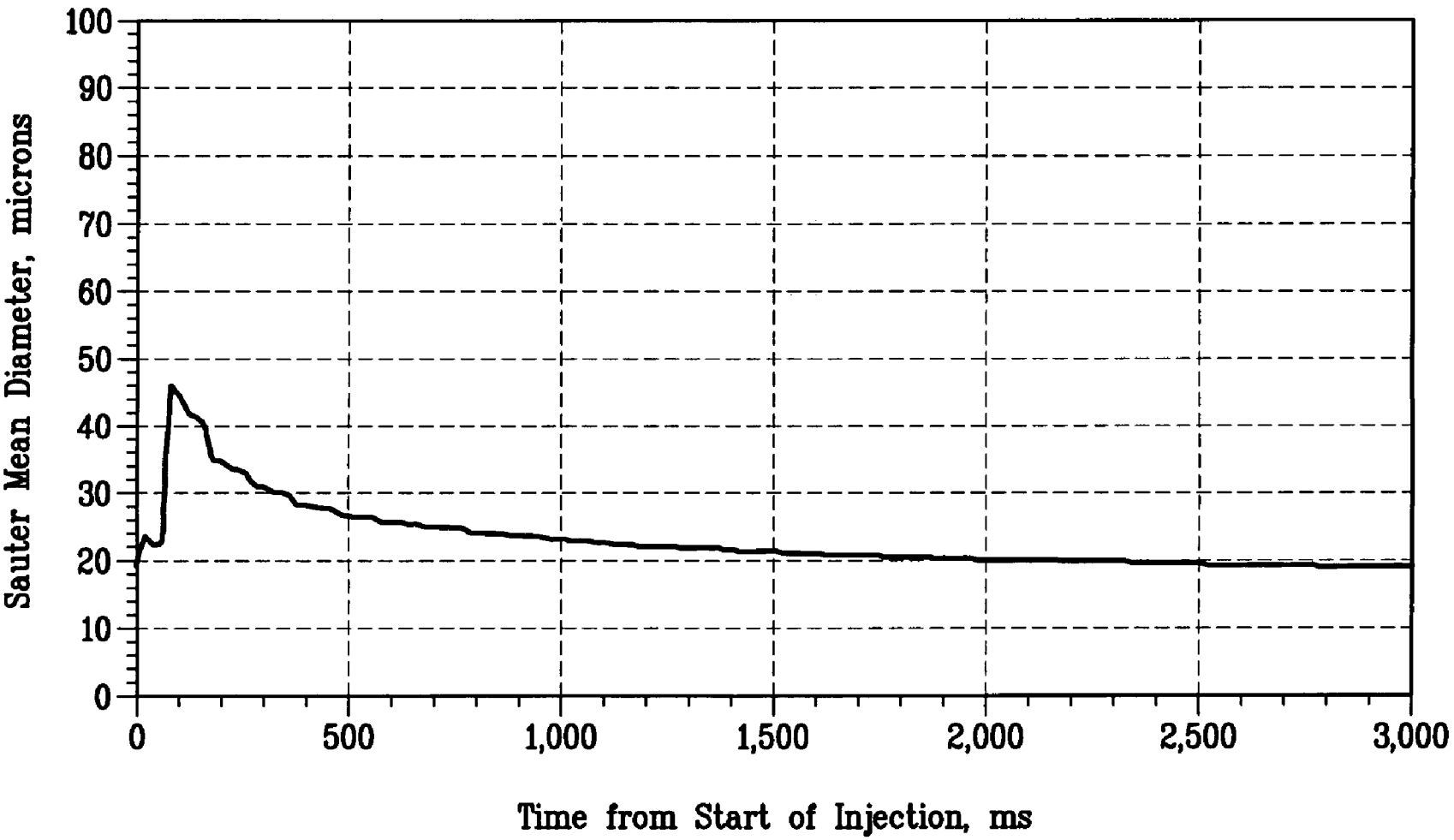
FIG. 11 presents fuel droplet size (SMD in microns) as a function of time from the start of injection.

FIG. 11 presents fuel droplet size (SMD in microns) as a function of the time from the start of injection, in ms, for the injector described in FIGS. 8 and 9. As shown, the capillary fuel injector's inherently low thermal inertia combined with a small sack volume enables good atomization from the start of injection, with the Sauter Mean Diameter is consistently below 50 microns.

Figure 12:
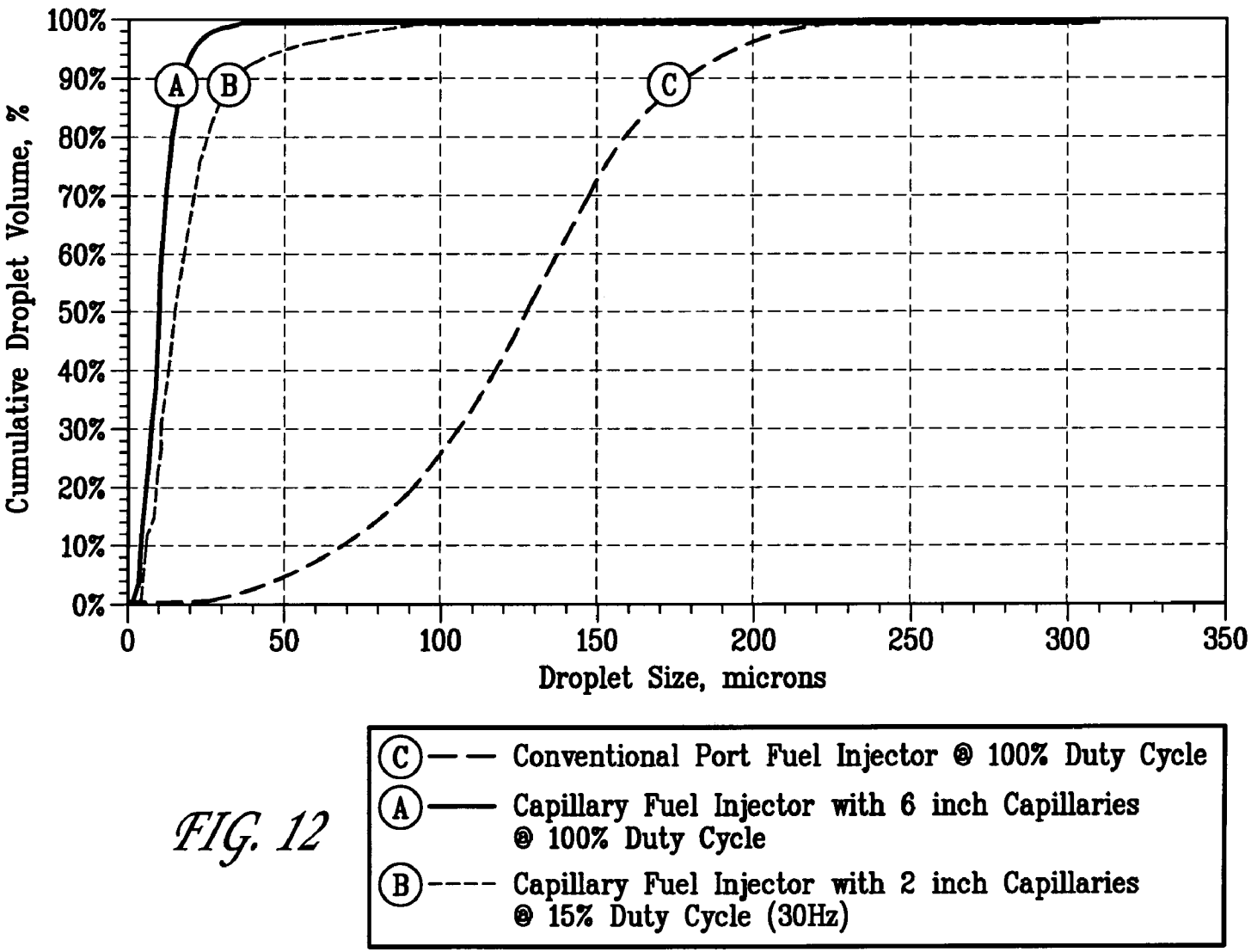
FIG. 12 presents cumulative fuel droplet volume, in percent, as a function of fuel droplet size (SMD in microns), for a variety of injectors.

FIG. 12 presents cumulative fuel droplet volume, in percent, as a function of fuel droplet size (SMD in microns), for a variety of injectors. As shown, compared to a capillary fuel injector of the type described with respect to FIG. 4 in U.S. application Ser. No. 10/342,267, the contents of which are hereby incorporated by reference in their entirety, an injector of the type described herein produces slightly larger droplets on average, but still with the great majority of the droplets (70% of the total mass) below 20 microns. It is important to note that the capillary fuel injector of the type shown in FIG. 4 of U.S. application Ser. No. 10/342,267 possesses four six-inch capillary passages and, as such, lack the ability possessed by the injectors described herein to be readily adapted to current production vehicles While the subject invention has been illustrated and described in detail in the drawings and foregoing description, the disclosed embodiments are illustrative and not restrictive in character. All changes and modifications that come within the scope of the invention are desired to be protected.

What is claimed is:

1. A fuel injector for delivering fuel to an internal combustion engine, comprising:

(a) a fuel injector housing;

(b) a system for metering vaporized fuel to the internal combustion engine, said system positioned within said fuel injector housing; and (c) a system for delivering an atomized stream of liquid fuel to an internal combustion engine, said system positioned within said fuel injector housing;

wherein the fuel injector is operable to transition from metering vaporized fuel to delivering an atomized stream of liquid fuel to an internal combustion engine.

2. The fuel injector of claim 1, wherein said system for metering vaporized fuel comprises:

(i) at least one capillary flow passage mounted within said fuel injector housing, said at least one capillary flow passage having an inlet end and an outlet end; and (ii) a heat source arranged along said at least one capillary flow passage, said heat source operable to heat the fuel within said at least one capillary flow passages to a level sufficient to change the fuel from a liquid state to a vapor state and deliver vaporized fuel from said outlet end of said at least one capillary flow passage.

3. The fuel injector of claim 2, wherein said system for metering vaporized fuel further comprises a valve positioned within said fuel injector housing and proximate to said outlet end of said at least one capillary flow passage.

4. The fuel injector of claim 3, wherein said valve is positioned downstream of said outlet end of said at least one capillary flow passage.

5. The fuel injector of claim 4, wherein said valve is a low-mass ball valve assembly operated by a solenoid.

6. The fuel injector of claim 5, wherein said low-mass ball valve assembly comprises a ball connected to a plate, the plate capable of moving as a result of a magnetic field created by actuation of said solenoid, and a conical sealing surface.

7. The fuel injector of claim 6, wherein said low-mass ball valve assembly further comprises a spring dimensioned to provide a spring force operable to push said ball against said conical section and block fluid flow from the injector.

8. The fuel injector of claim 7, further comprising an exit orifice, wherein movement of said plate caused by actuation of said solenoid causes said ball to be drawn away from said conical sealing surface, allowing fuel to flow through said exit orifice.

9. The fuel injector of claim 5, wherein said system for delivering an atomized stream of liquid fuel to an internal combustion engine comprises an orifice plate having a plurality of orifices.

10. The fuel injector of claim 9, wherein said valve of said system for metering vaporized fuel is operable to meter the liquid fuel when the fuel injector transitions from metering vaporized fuel to delivering an atomized stream of liquid fuel.

11. The fuel injector of claim 10, wherein said valve of said system for metering vaporized fuel is positioned upstream of said orifice plate.

12. The fuel injector of claim 2, wherein said at least one capillary flow passage is formed within a tube selected from the group consisting of stainless steel and nickel-chromium alloy.

13. The fuel injector of claim 12, wherein said at least one capillary flow passage has an internal diameter from about 0.020 to about 0.030 inches and a heated length of from about 1 to about 3 inches.

14. The fuel injector of claim 2, further comprising:

(d) means for cleaning deposits formed during operation of the injector.

15. The fuel injector of claim 14, wherein said means for cleaning deposits employs a solvent comprising liquid fuel and wherein said heat source is phased-out during cleaning of said at least one capillary flow passage.

16. The fuel injector of claim 2, wherein said heat source includes a resistance heater.

17. The fuel injector of claim 1, wherein said system for delivering an atomized stream of liquid fuel to an internal combustion engine comprises an orifice plate having a plurality of orifices.

18. The fuel injector of claim 1, wherein the internal combustion engine is an alcohol-fueled engine.

19. The fuel injector of claim 1, wherein the internal combustion engine is a gasoline direct-injection engine.

20. The fuel injector of claim 1, wherein the internal combustion engine is part of a hybrid-electric vehicle.

21. The fuel injector of claim 1, further comprising:

(d) means for cleaning deposits formed during operation of the injector.

22. The fuel injector of claim 21, wherein said means for cleaning deposits employs a solvent comprising liquid fuel from the liquid fuel source and wherein the heat source is phased-out during cleaning of said at least one capillary flow passage.

23. A fuel injector for vaporizing and metering a liquid fuel to an internal combustion engine, comprising:

(a) at least one capillary flow passage, said at least one capillary flow passage having an inlet end and an outlet end;

(b) a heat source arranged along said at least one capillary flow passage, said heat source operable to heat the liquid fuel in said at least one capillary flow passages to a level sufficient to change from the liquid state to a vapor state and deliver vaporized fuel from said outlet end of said at least one capillary flow passage; and (c) a valve for metering vaporized fuel to the internal combustion engine, said valve located proximate to said outlet end of said at least one capillary flow passage.

24. The fuel injector of claim 23, wherein said valve for metering fuel to the internal combustion engine is a low-mass ball valve assembly operated by a solenoid.

25. The fuel injector of claim 23, wherein said at least one capillary flow passage is formed within a tube selected from the group consisting of stainless steel and nickel-chromium alloy.

26. The fuel injector of claim 25, wherein said at least one capillary flow passage has an internal diameter from about 0.020 to about 0.030 inches and a heated length of from about 1 to about 3 inches.

27. The fuel injector of claim 23, wherein said heat source includes a resistance heater.

28. The fuel injector of claim 23, wherein said valve for metering fuel to the internal combustion engine is positioned downstream of said outlet end of said at least one capillary flow passage.

29. The fuel injector of claim 23, whereby the stream of vaporized fuel from said outlet end of said at least one capillary flow passage is introduced upstream of said valve for metering fuel.

30. A fuel system for use in an internal combustion engine, comprising:

(a) a plurality of fuel injectors, each of said plurality of fuel injectors having an inlet and an outlet and including (i) a fuel injector housing; (ii) a system for metering vaporized fuel to the internal combustion engine, said system positioned within said fuel injector housing; and (iii) a system for delivering an atomized stream of liquid fuel to an internal combustion engine, said system positioned within said fuel injector housing;

(b) a liquid fuel supply system in fluid communication with said plurality of fuel injectors; and (c) a controller in electronic communication with the plurality of fuel injectors and adapted to select delivery of vaporized fuel or liquid fuel from said plurality of fuel injectors.

31. The fuel system of claim 30, wherein said system for metering vaporized fuel comprises:

(1) at least one capillary flow passage mounted within said fuel injector housing, said at least one flow passage having an inlet end and an outlet end; and (2) a heat source arranged along said at least one capillary flow passage, said heat source operable to heat the fuel within said at least one capillary flow passage to a level sufficient to change the fuel from a liquid state to a vapor state and deliver vaporized fuel from said outlet end of said at least one capillary flow passage.

32. The fuel system of claim 31, wherein said system for metering vaporized fuel further comprises a valve positioned within said fuel injector housing and proximate to said outlet end of said at least one capillary flow passage.

33. The fuel system of claim 32, wherein said valve is positioned downstream of said outlet end of said at least one capillary flow passage.

34. The fuel system of claim 33, wherein said valve is a low-mass ball valve assembly operated by a solenoid.

35. The fuel system of claim 34, wherein said system for delivering an atomized stream of liquid fuel to an internal combustion engine comprises an orifice plate having a plurality of orifices.

36. The fuel system of claim 35, wherein said valve of said system for metering vaporized fuel is operable to meter the liquid fuel when said controller selects delivery of atomized liquid fuel.

37. The fuel system of claim 36, wherein said at least one capillary flow passage has an internal diameter from about 0.020 to about 0.030 inches and a heated length of from about 1 to about 3 inches.

38. The fuel system of claim 31, further comprising:

(d) means for cleaning deposits formed during operation of the injector.

39. The fuel system of claim 38, wherein said means for cleaning deposits employs a solvent comprising liquid fuel and wherein said heat source is phased-out during cleaning of said at least one capillary flow passage.

40. The fuel system of claim 31, wherein said heat source includes a resistance heater.

41. The fuel system injector of claim 30, wherein said system for delivering an atomized stream of liquid fuel to an internal combustion engine comprises an orifice plate having a plurality of orifices.

42. The fuel system injector of claim 30, wherein the internal combustion engine is an alcohol-fueled engine.

43. The fuel system injector of claim 30, wherein the internal combustion engine is a gasoline direct-injection engine.

44. The fuel system of claim 30, wherein the internal combustion engine is part of a hybrid-electric vehicle.

45. The automobile of claim 33, wherein said valve is a low-mass ball valve assembly operated by a solenoid.

46. A fuel system for use in an internal combustion engine, comprising (a) a plurality of fuel injectors, each injector including (i) at least one capillary flow passage, each of said at least one capillary flow passage having an inlet end and an outlet end; (ii) a heat source arranged along said at least one capillary flow passage, said heat source operable to heat the liquid fuel in said at least one capillary flow passage to a level sufficient to change from the liquid state to a vapor state and deliver a stream of vaporized fuel from said outlet end of said at least one capillary flow passage; and (iii) a valve for metering vaporized fuel to the internal combustion engine, said valve located proximate to said outlet end of said at least one capillary flow passage;

(b) a liquid fuel supply system in fluid communication with said plurality of fuel injectors; and (c) a controller to control the supply of fuel to said plurality of fuel injectors.

47. The fuel system of claim 46, wherein said valve for metering fuel to the internal combustion engine is a low-mass ball valve assembly operated by a solenoid.

48. The fuel system of claim 47, wherein said low-mass ball valve assembly comprises a ball connected to a plate, the plate capable of moving as a result of a magnetic field created by actuation of said solenoid and a conical sealing surface.

49. The fuel system of claim 48, wherein said at least one capillary flow passage is formed within a tube selected from the group consisting of stainless steel and nickel-chromium alloy.

50. The fuel system of claim 46, further comprising:

(d) means for cleaning deposits formed during operation of the injector.

51. The fuel system of claim 50, wherein said means for cleaning deposits employs a solvent comprising liquid fuel from the liquid fuel source and wherein the heat source is phased-out during cleaning of said capillary flow passage.

52. A method of delivering fuel to an internal combustion engine, comprising the steps of:

(a) supplying liquid fuel to at least one capillary flow passage of a fuel injector;

(b) causing vaporized fuel to pass through an outlet of the at least one capillary flow passage by heating the liquid fuel in the at least one capillary flow passage; and (c) metering the vaporized fuel to the internal combustion engine through a valve located proximate to said outlet of the at least one capillary flow passage.

53. The method of claim 52, wherein said steps of causing vaporized fuel to pass through an outlet of the at least one capillary flow passage and of metering the vaporized fuel to the internal combustion engine is limited to start-up and warm-up of the internal combustion engine.

54. The method of claim 53, further comprising delivering liquid fuel to the internal combustion engine when the internal combustion engine reaches a fully warmed condition.

55. The method of claim 54, further comprising the step of monitoring at least one signal indicative of the degree of engine warm-up.

56. The method of claim 55, further comprising the step of controlling a transition from metering vaporized fuel to the delivery of liquid fuel through the use of a controller in electronic communication with the fuel injector based on the monitoring of the at least one signal indicative of the degree of engine warm-up.

57. The method of claim 54, wherein the step of delivering liquid fuel to the internal combustion engine includes the step of atomizing a stream of liquid fuel.

58. The method of claim 57, wherein the step of atomizing a stream of liquid fuel employs an orifice plate having a plurality of orifices.

59. The method of claim 58, further comprising cleaning periodically the at least one capillary flow passage.

60. The method of claim 59, wherein said periodic cleaning comprises (i) phasing-out said heating of the plurality of capillary flow passages, (ii) supplying a solvent to the at least one capillary flow passage, whereby deposits formed in the at least one capillary flow passage are substantially removed.

61. The method of claim 60, wherein the solvent includes liquid fuel from the liquid fuel source.

62. The method of claim 52, wherein the vaporized fuel mixes with air and forms an aerosol prior to combustion, the method including forming the aerosol with a particle size distribution, a fraction of which is 25 μm or less prior to igniting the vaporized fuel to initiate combustion.

63. The method of claim 52, wherein in step (c) the valve for metering fuel to the internal combustion engine is a low-mass ball valve assembly operated by a solenoid.

64. The method of claim 52, wherein each of the at least one capillary flow passage is formed within a tube selected from the group consisting of stainless steel and nickel-chromium alloy.

65. The method of claim 62, wherein the at least one capillary flow passage has an internal diameter of from about 0.020 to about 0.030 inches and a heated length of from about 1 to about 3 inches.

66. The method of claim 52, wherein in step (b) said heating is achieved through the use of a resistance heater.

67. The method of claim 52, wherein in step (c) the valve for metering fuel to the internal combustion engine is positioned downstream of the outlet of the at least one capillary flow passage.

68. The method of claim 52, whereby the vaporized fuel is introduced upstream of the valve for metering fuel.

69. The method of claim 52, wherein the internal combustion engine is an alcohol-fueled engine.

70. The method of claim 52, wherein the internal combustion engine is a gasoline direct-injection engine.

71. The method of claim 52, wherein the internal combustion engine is part of a hybrid-electric vehicle.

72. An automobile, comprising:

(a) an internal combustion engine positioned within a body; and (b) a fuel system for fueling said internal combustion engine, said fuel system including:

(i) a plurality of fuel injectors, each of said plurality of fuel injectors having an inlet and an outlet and including (1) a fuel injector housing; (2) a system for metering vaporized fuel to the internal combustion engine, said system positioned within said fuel injector housing; and (3) a system for delivering an atomized stream of liquid fuel to an internal combustion engine, said system positioned within said fuel injector housing;

(ii) a liquid fuel supply system in fluid communication with said plurality of fuel injectors; and (iii) a controller in electronic communication with the plurality of fuel injectors and adapted to select delivery of vaporized fuel or liquid fuel from said plurality of fuel injectors.

73. The automobile of claim 72, wherein said system for metering vaporized fuel comprises:

(2i) a plurality of capillary flow passages mounted within said fuel injector housing, each of said plurality of flow passages having an inlet end and an outlet end; and (2ii) a heat source arranged along each of said plurality of capillary flow passages, said heat source operable to heat the fuel within each of said plurality of capillary flow passages to a level sufficient to change the fuel from a liquid state to a vapor state and deliver vaporized fuel from each said outlet end of said plurality of capillary flow passages.

74. The automobile of claim 73, wherein said system for metering vaporized fuel further comprises a valve positioned within said fuel injector housing and proximate to each said outlet end of said plurality of capillary flow passages.

75. The automobile of claim 74, wherein said valve is positioned downstream of each said outlet end of said plurality of capillary flow passages.

* * * * *